US005549161A

United States Patent [19]

Gomez et al.

[11] Patent Number: 5,549,161

[45] Date of Patent: Aug. 27, 1996

[54] OVERPULL SHIFTING TOOL

[75] Inventors: Alfredo Gomez; William M. Richards, both of Houston; Douglas J. Murray, Humble, all of Tex.

[73] Assignee: Baker Hughes Incorporated, Houston, Tex.

[21] Appl. No.: 400,334

[22] Filed: Mar. 6, 1995

[51] Int. Cl.[6] ..... E21B 34/12; E21B 34/14; E21B 23/00

[52] U.S. Cl. ..... 166/255.1; 166/332.1; 166/332.4; 166/381; 166/386

[58] Field of Search ..... 166/386, 385, 166/383, 381, 237, 334, 384, 240

[56] References Cited

U.S. PATENT DOCUMENTS

| | | | |
|---|---|---|---|
| 3,874,634 | 4/1975 | Gazda | 166/322 |
| 4,896,721 | 1/1990 | Welch | 166/214 |
| 4,917,191 | 4/1990 | Hopmann et al. | 166/381 |
| 4,928,772 | 5/1990 | Hopmann | 166/386 |
| 5,090,481 | 2/1992 | Pleasants et al. | 166/373 |
| 5,183,114 | 2/1993 | Mashaw, Jr. et al. | 166/319 |
| 5,211,241 | 5/1993 | Mashaw, Jr. et al. | 166/320 X |
| 5,305,833 | 4/1994 | Collins | 166/386 |
| 5,309,988 | 5/1994 | Shy et al. | 166/72 |
| 5,325,917 | 7/1994 | Szarka | 166/240 |
| 5,355,953 | 10/1994 | Shy et al. | 166/250 |

OTHER PUBLICATIONS

Baker Oil Tools, Baker Flow Control Shifting Tools, Procedures & Guidelines for Baker Model CMU and CMD Sliding Sleeve, date Unknown.

Baker Oil Tools, Standard Products Technical Unit Instruction and Procedure Information, date unknown.

Otis Subsurface Wireline Equipment, Sliding Side-Door Circulation Equipment, Composite Catalog, date unknown, p. 114.

Otis Subsurface Wireline Equipment, Positioning Tools, Composite Catalog, date unknown, p. 268.

Specialty Machine & Supply, Inc. pp. 56–58.

Hunt, Bottom Hole Assembly Equipment, Composite Catalog, date unknown, page unknown.

DJ-5/DJ-6 Drilling Jars, Composite Catalog, date unknown, p. 733.

ST-5 Shock Tool, Composite Catalog, date unknown, p. 732.

Griffith hydraulic/mechanical jar, Composite Catalog, date unknown, pp. 958–959.

Anadrill, Earthquaker Mechanical Drilling Jars, date unknown, pages unknown.

Bowen Drilling Tools, Bowen Hydromechanical Drilling Jars, Composite Catalog, date unknown, p. 426.

Bowen Surface Bumper Jar, Composite Catalog, date unknown, p. 407.

*Primary Examiner*—Stephen J. Novosad
*Attorney, Agent, or Firm*—Rosenblatt & Redano

[57] ABSTRACT

A shifting tool is disclosed which allows movement of a shifting sleeve, to be followed by an additional force applied to ensure complete stroking of the shifting sleeve. This is accomplished by a shifting key to normally shift the shifting sleeve, followed by an overpull key which engages while the shifting key is still engaged. Once a predetermined force has been applied to the overpull key, the force applied from the surface is removed so that the tool may disengage from the sleeve. Subsequent manipulation, without necessarily any removal from the wellbore, if it does not result in a reengagement, provides feedback that the shifting sleeve has, in fact, shifted its full stroke. An emergency release is available which actuated by an overpull force beyond a predetermined level, applied while the overpull key is engaged for an emergency release from the shifting sleeve.

45 Claims, 38 Drawing Sheets

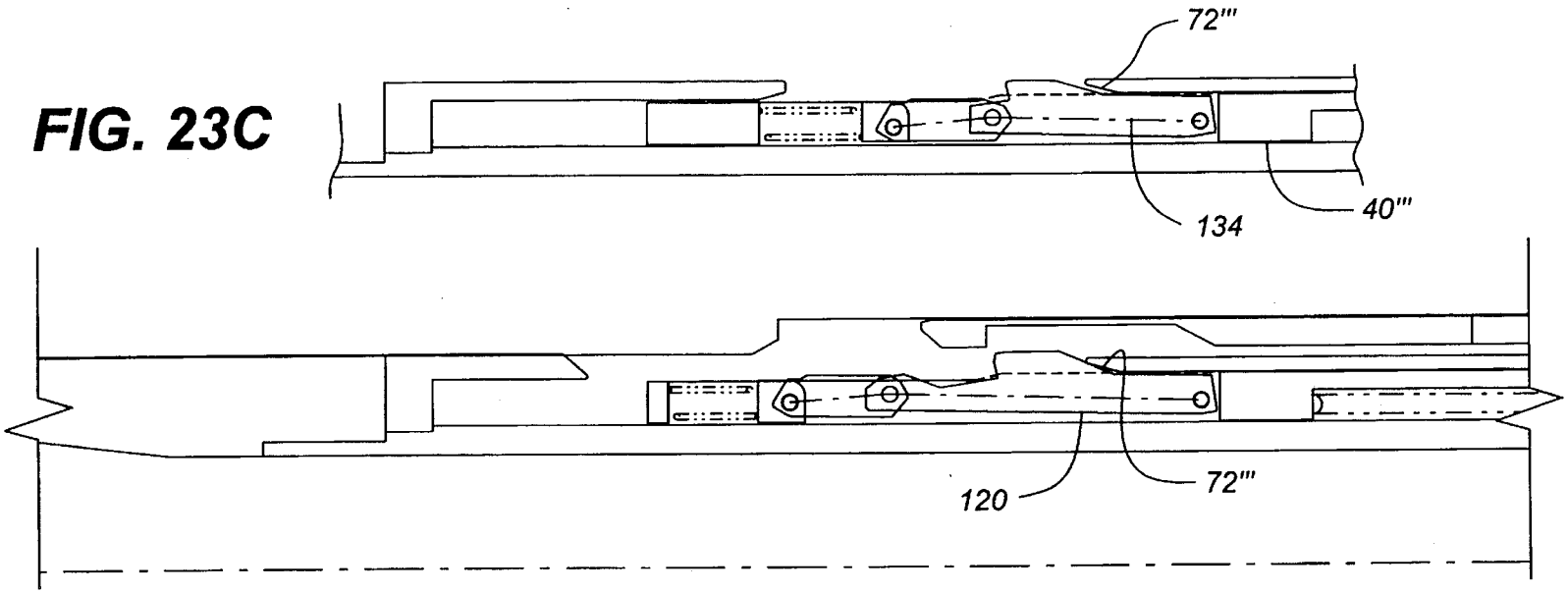
FIG. 23C
FIG. 23A
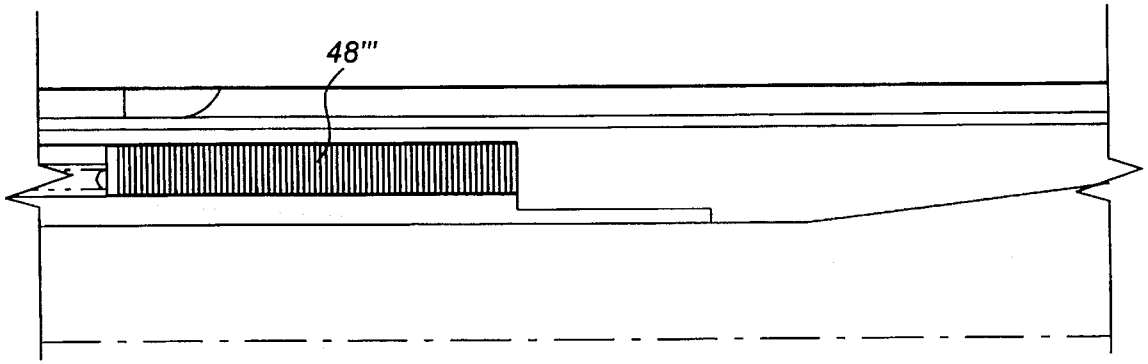
FIG. 23B

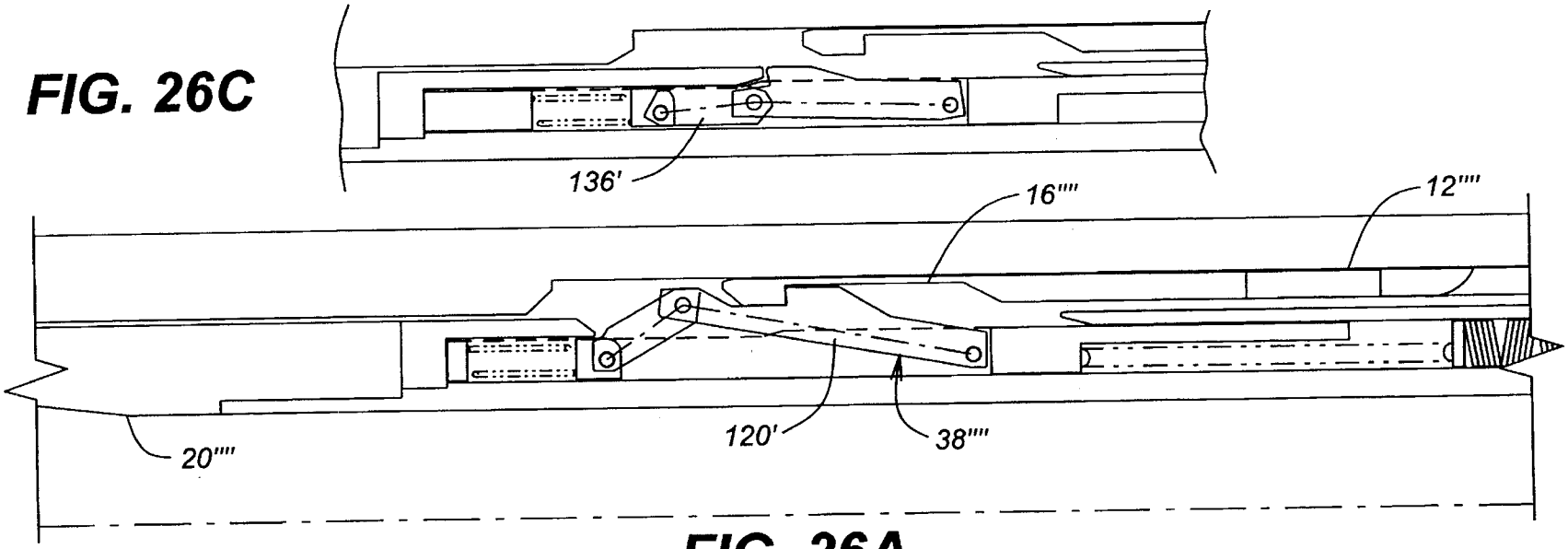
FIG. 26A
FIG. 26C
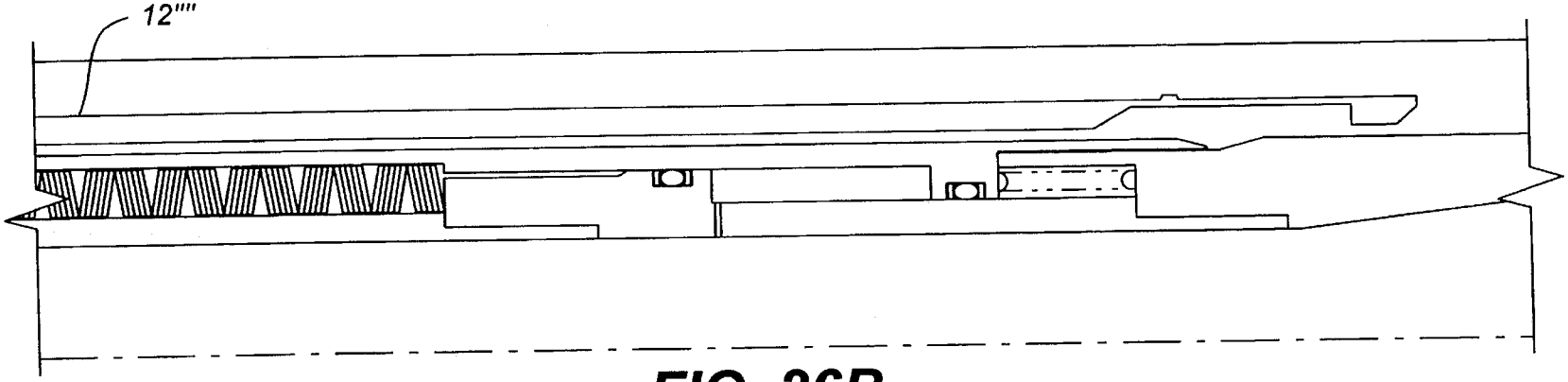
FIG. 26B

OVERPULL SHIFTING TOOL

FIELD OF THE INVENTION

The field of this invention relates to shifting tools used for shifting sleeves downhole for opening or closing passages or for other further downhole operations.

BACKGROUND OF THE INVENTION

Sliding sleeve valves have been a part of oilfield completions for many years, traditionally shifted with a tool carried on a wireline. In the past few years, these sleeves have been run in increasingly deviated wells, including horizontal wells. In these cases, wireline has not been a suitable method of conveying the shifting tools, and tubing has had to be employed, both threaded and coiled tubing. Some specialized shifting tools have been made for these applications, most of them based on wireline tool designs. One drawback to this has been the feedback of when the shifting operation has been completed. Traditional sliding sleeves and wireline shifting tools have relied on the fact that the weight of the wire is not a significant force, compared to the force to shift a sleeve, or the weight of the tools used. Jarring forces were used to shift sleeves. The move towards tubing-conveyed shifting tools means that the force required to shift the sliding sleeve is now a small portion of the weight of the tubing string. One method employed to overcome this is to increase the force required to shift the sleeve until it is a significant force. This has the disadvantage that if well debris adds to the required force, then forces can become unacceptably high.

To overcome this, a new feedback method has been developed. This new shifting tool has two distinctly different sets of keys. When the sleeve has shifted, a significant force can be applied to it, over and above what it would normally take to shift. If the action of shifting the sleeve is repeated, the shifting tool will not reengage if the sliding sleeve has shifted fully. If it has not, then the shifting action is repeated with increasing force until shifting is completed.

A second feature of this shifting tool is that it can be released from a sliding sleeve by application of a predetermined force. Almost all shifting tools on the market have an emergency release system which is commonly a shear mechanism. When the shear force of the mechanism is reached, the tool retracts the shifting mechanism, allowing the shifting tool to pass. The tool cannot now engage this sleeve or any other until it is removed from the well and the shear system replaced. This new shifting tool can be sheared free in the same manner, but it can also be equipped with a resettable mechanism which allows the tool to be released form the sliding sleeve, but instead of requiring the tool to be removed from the well and redressed, the tool resets itself back to the normal running position. This can save considerable trip time when multiple shifting operations have to be made in a single well. To pass beyond a sliding sleeve which is stuck, a tool which shears out would not allow passage. A shifting tool that can reset itself can pass through that stuck sliding sleeve and shift subsequent sliding sleeves.

The shifting tool can also be outfitted with a hydraulic or mechanical selective mechanism which keeps all the shifting mechanisms retracted, allowing the tool to pass up and down the well, shifting only those sliding sleeves which the operator selects. The tool has the advantage that, through selection of appropriate forces, it can be conveyed and operated using any method, including wireline, coiled tubing, threaded and jointed tubing.

SUMMARY OF THE INVENTION

A shifting tool is disclosed which allows movement of a sliding sleeve valve and a new feedback method to indicate whether the sliding sleeve has been fully shifted. The feedback method is comprised of two stages that are identifiable by surface operators. The feedback method begins with the movement of the sliding sleeve valve to be followed by an additional applied force that is identifiable by surface operators. Subsequent manipulation, without necessarily any removal from the wellbore, if it does not result in a reengagement, provides feedback that the shifting sleeve has, in fact, shifted its full stroke. This new method is accomplished by a shifting key to normally shift the shifting sleeve, followed by an overpull key which engages while the shifting key is still engaged. Once a predetermined force has been applied to the overpull key, the force applied from the surface is removed so that the tool may disengage from the sleeve. An emergency release is available which is actuated by an overpull force beyond a predetermined level while the overpull key is engagedy. Such a force will release the overpull key from the shifting sleeve and reset while the tool is in the wellbore. The disclosed mechanisms are an improvement over traditional shear mechanisms that require the tool be brought to the surface to be reset. In addition, a method to activate the shifting tool with wellbore fluids is disclosed. A hydraulic chamber is added to the disclosed tool to allow it to be activated by the wellbore fluids, thus allowing it to pass through numerous sliding sleeves without engaging the sleeve. The feedback mechanism, resetting emergency release, and hydraulic chamber are modular in design and can be fitted in different combinations on the disclosed shifting tool embodiments or any traditional shifting tool.

BRIEF DESCRIPTION OF THE DRAWINGS

FIGS. 23*a* and 23*b* and 23*c* indicate the emergency release feature of the tool shown in FIG. 22, which results in camming the overpull key out of the sleeve, as well as camming the shifting key out of the sleeve so that both are fully retracted for release.

FIGS. 26*a* and 26*b* and 26*c* are the view of FIG. 25 after applying fluid pressure to a variable-volume cavity which results in the shifting key moving outwardly into the shifting sleeve.

DETAILED DESCRIPTION OF THE PREFERRED EMBODIMENT

Figure 1A:
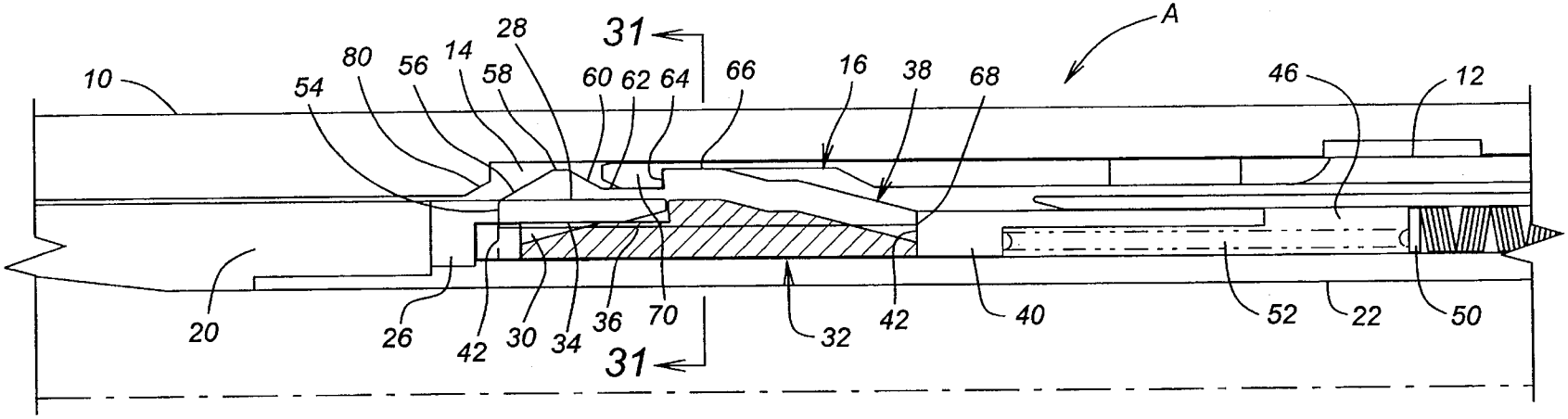
FIGS. 1*a* and 1*b* are a sectional elevational view of one embodiment of the present invention, shown in the run-in position with the shifting key engaged.
Figure 31:
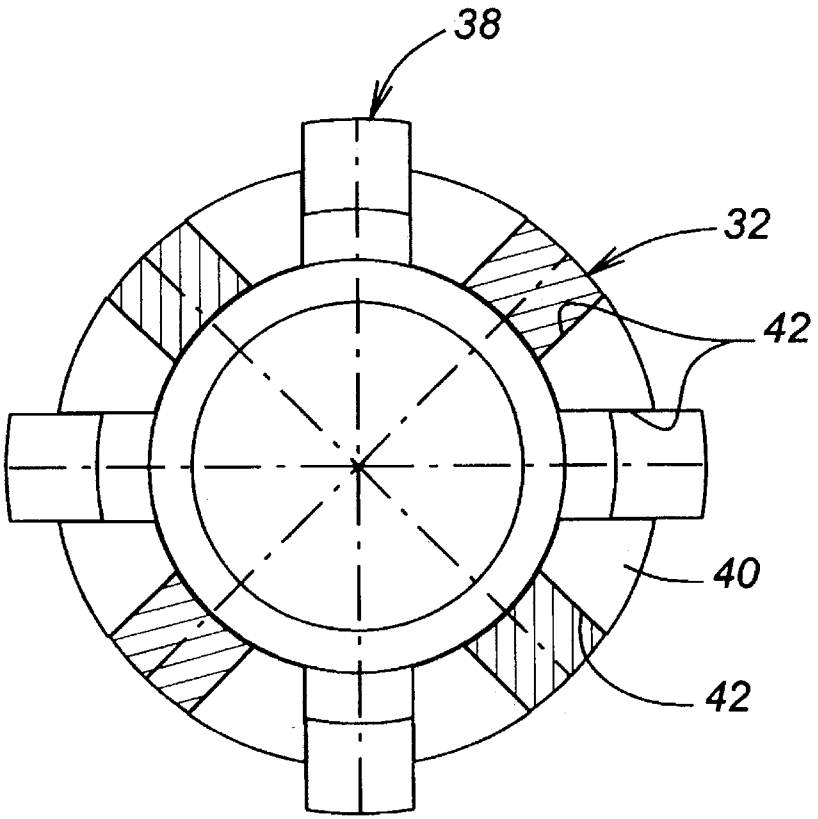
FIG. 31 is a section view drawn along line 31—31 of FIG. 1*a*, indicating the displaced position between the shifting keys and the overpull keys.
Figure 32A:
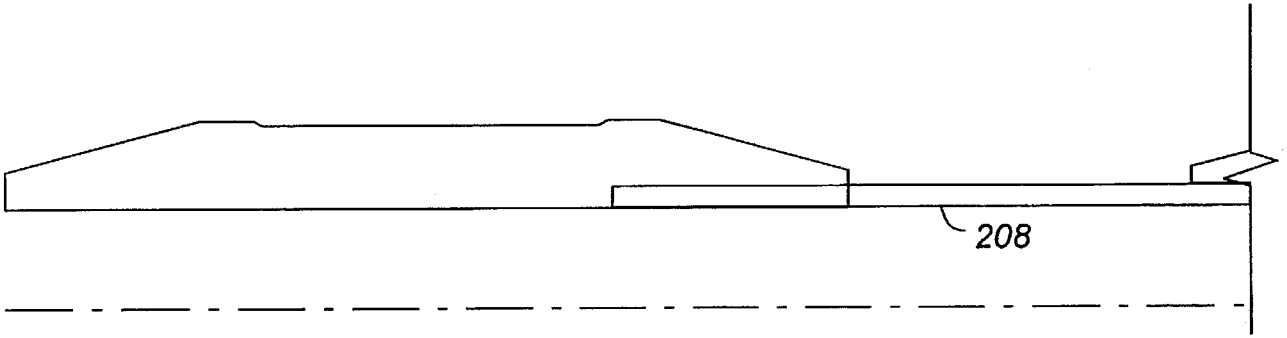
FIGS. 32(*a*)–(*g*) illustrate the preferred embodiment of the resettable emergency release mechanism, which differs in design from the Belleville washer design for the emergency release shown in FIGS. 1–6, and the preferred shifting key and overpull key design in the run-in mode.
Figure 33A:
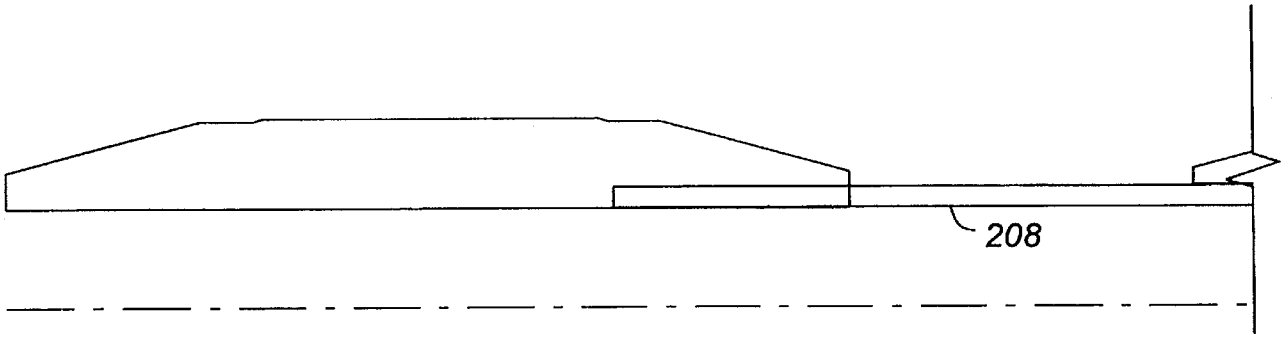
FIGS. 33(*a*)–(*g*) represent the preferred embodiment of the resettable emergency release mechanism in the released position.
Figure 32B:
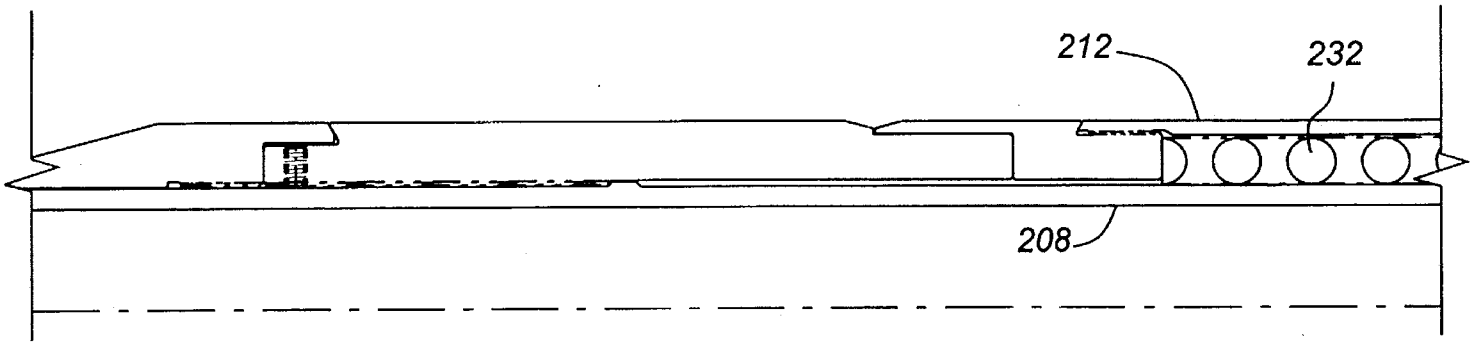
Figure 33B:
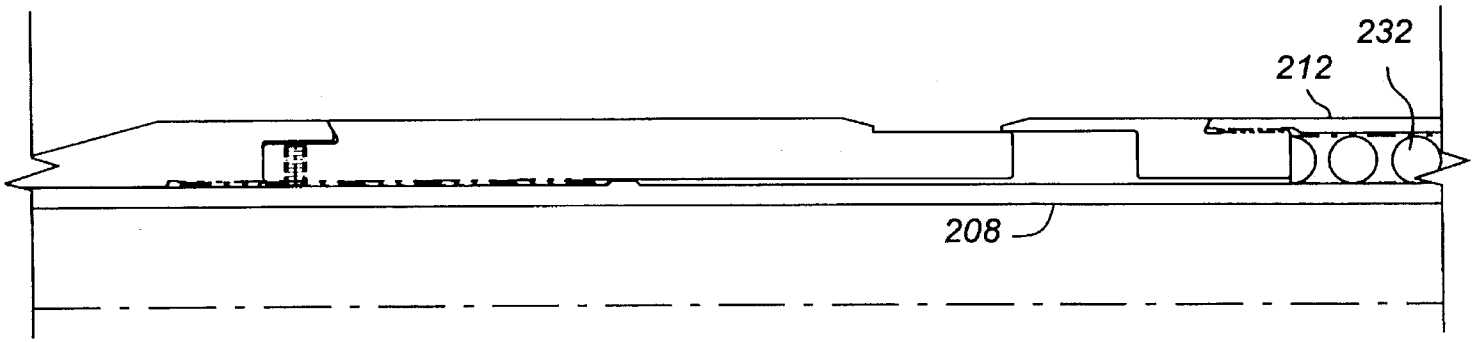
Figure 32C:
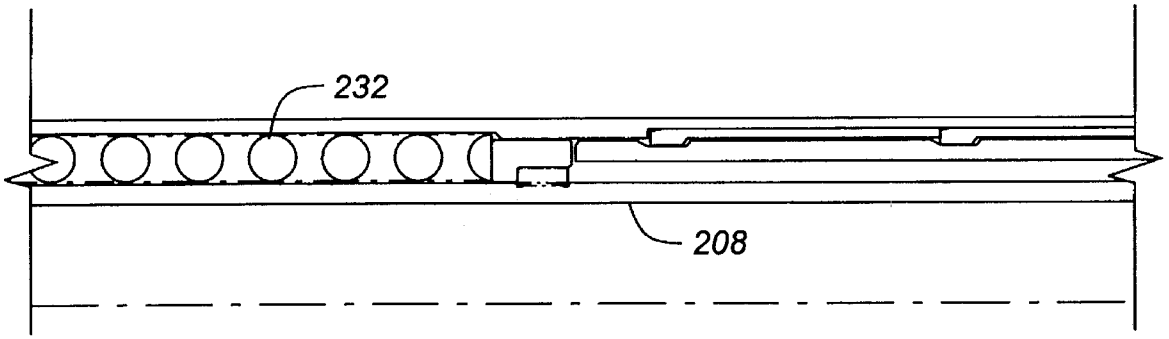
Figure 33C:
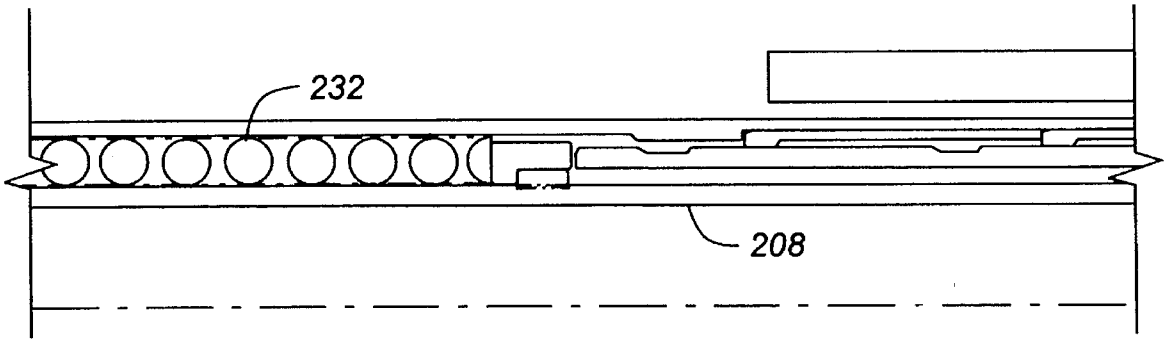
Figure 32D:
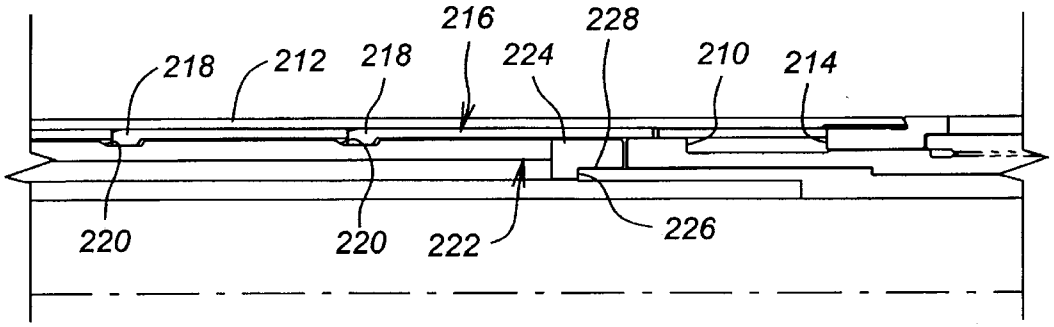
Figure 33D:
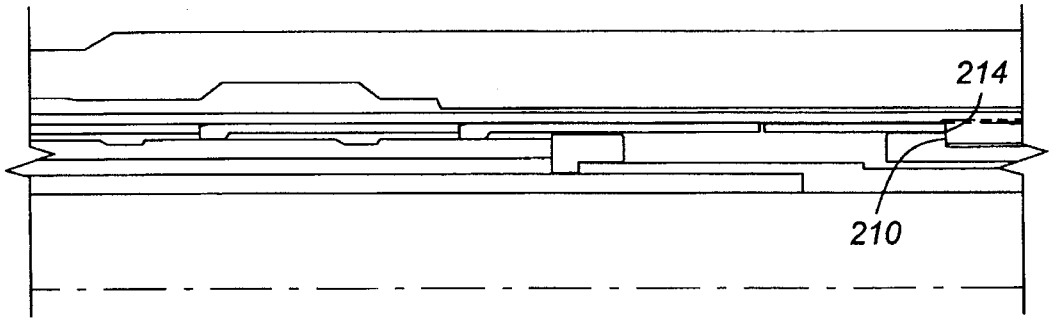
Figure 32E:
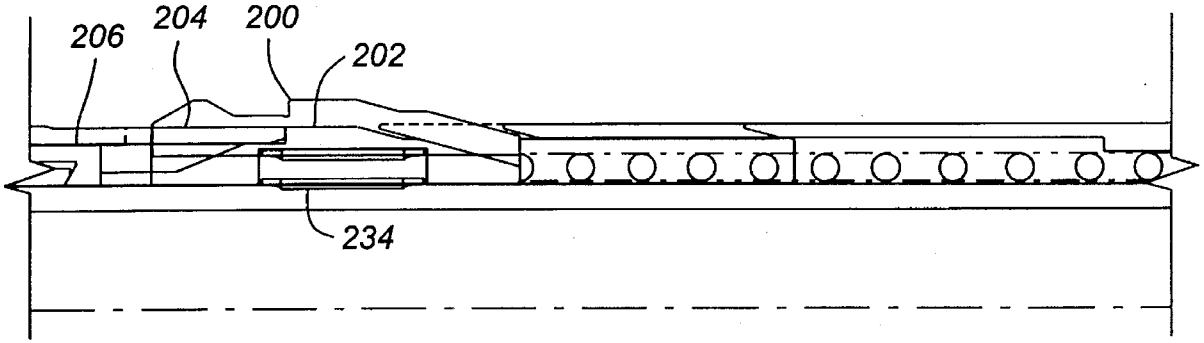
Figure 33E:
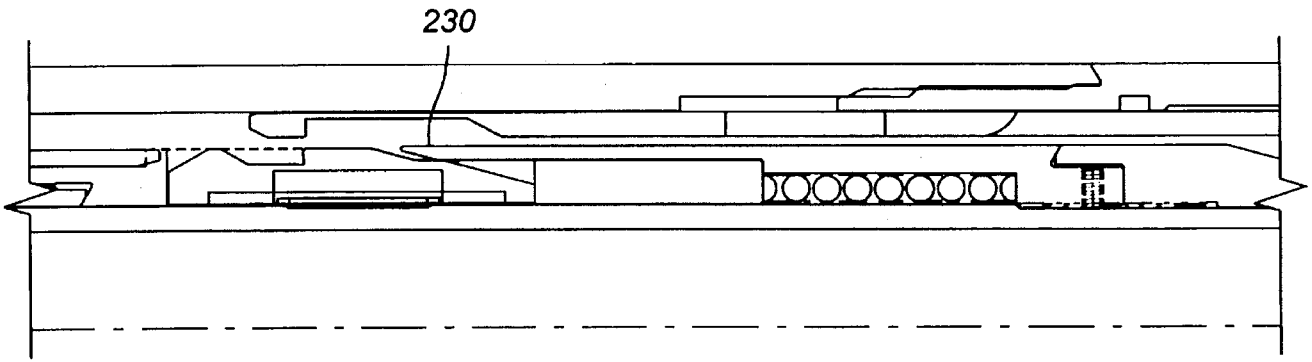
Figure 32F:
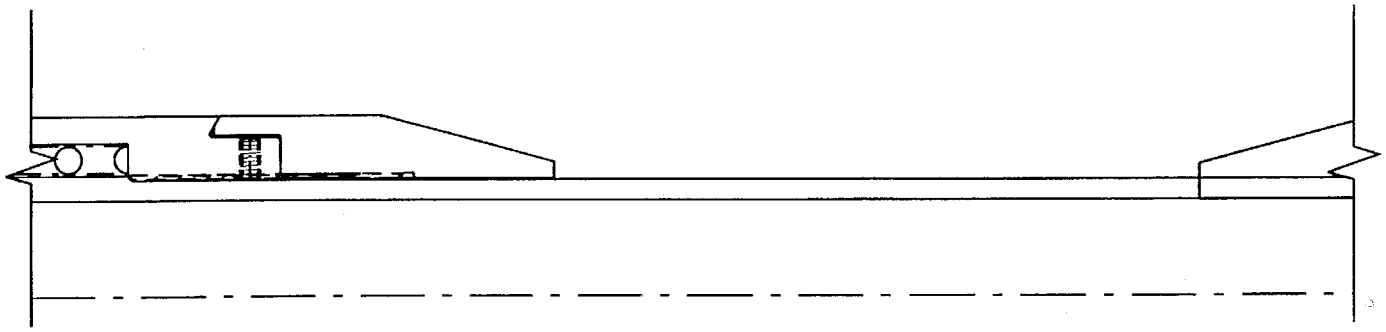
Figure 33F:
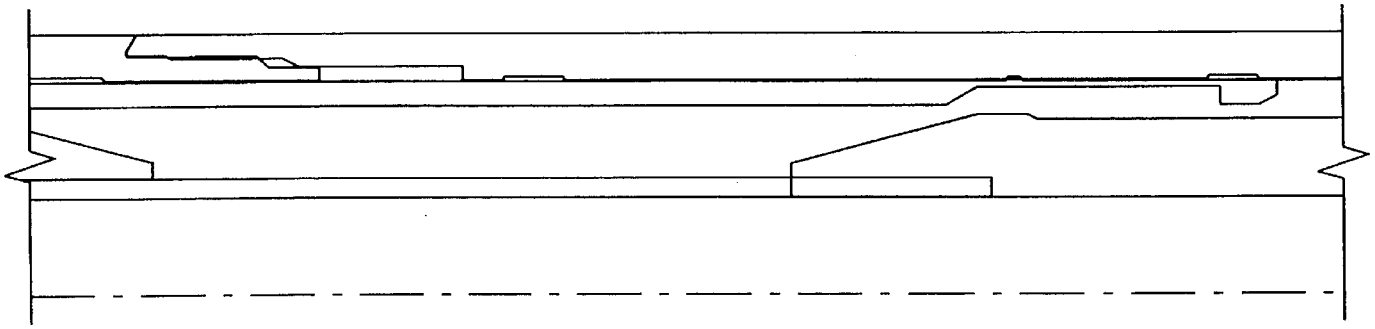
Figure 32G:
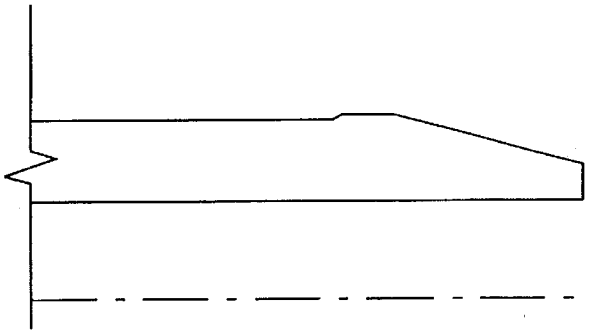
Figure 33G:
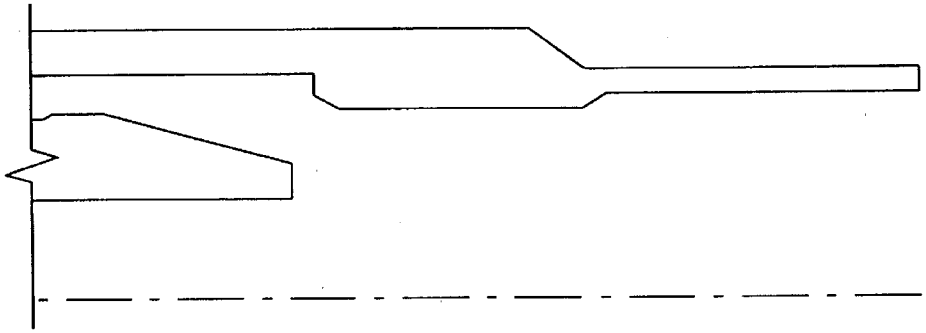

The apparatus A is illustrated in FIG. 1. A tubular 10, such as a casing liner or tubing string, has mounted therein a shifting sleeve 12. Sleeve 12 is movable in recess 14 in opposite directions by engagement of the apparatus A in grooves 16 or 18. The apparatus A comprises a running tool which has a top sub 20. Top sub 20 is connected to body 22, which is in turn connected to bottom sub 24. Body 22 and top sub 20 retain upper retractor 26. In section, upper retractor 26 has an L-shape with its longer segment 28 extending parallel to body 22, forming a plurality of recesses 30 which initially trap overpull keys 32, as shown in FIG. 1*a*. This occurs because surface 34 of segment 28 overlaps longitudinally surface 36 of overpull keys 32. Overpull keys 32 are biased by springs (not shown) radially outwardly toward groove 16 but are initially retained in a retracted position, extending no further out than segment 28 during the run-in position. As seen in FIG. 31, a series of shifting keys 38 are radially offset from the overpull keys 32. As shown in FIG. 1*a*, both the shifting keys 38 and overpull keys 32 are able to project through key cage 40 through a window 42 which is aligned with each shifting key 38 and overpull key 32, as shown in FIG. 31. Collets instead of keys or lugs can be used for shifting or overpull keys without departing from the spirit of the invention.

The bottom sub 24 has a retrieving sleeve 44 extending therefrom and generally parallel to body 22 to define an annular cavity 46 therebetween. Disposed in annular cavity 46 is a stack of Belleville washers 48. A spacer 50 sits between washers 48 and spring 52. Spring 52 bears on key cage 40 and spacer 50.

Looking now at FIG. 1*a*, it will be seen that the shifting key 38 comprises surfaces of interest 54–68. Surface 54 is at the top end and is guided by window 42. Surfaces 56, 58, and 60 represent a cam mounted toward the upper end of shifting keys 38 for a purpose which will be described below. Surfaces 60, 62, 64, and 66 form adjacent depression to accommodate top end 70 of sleeve 12, as well as a projection to enter, that is, engage, groove 16 of sleeve 12, as shown in FIG. 1*a*. In the embodiment shown in FIG. 1*a* with an outward bias always acting on shifting keys 38, surface 64 can enter groove 16 as long as the sleeve 12 has enough of a gap adjacent the upper end or radial surface 78 of recess 14 to accommodate the cam which comprises surfaces 56, 58, and 60.

It should be noted that while the orientation of the apparatus A is now being described is illustrative of pulling the sleeve 12 upwardly through groove 16, the entire assembly can be inverted and the apparatus A can be useful in shifting the sleeve 12 in the opposite direction through an attachment to groove 18 in a similar manner, with the only difference being a reversal of the direction of the forces applied. Additionally, while biasing elements such as spring 52 or Belleville washers 48 have been disclosed, other biasing devices or mechanisms can be employed without departing from the spirit of the invention. For reasons which will be described below, the resistance to being compressed of the Belleville washer stack 48 is significantly higher than the spring rate of spring 52. The application greatly determines the differences in spring rates between the spring 52 and the Belleville washer stack 48.

Figure 1B:
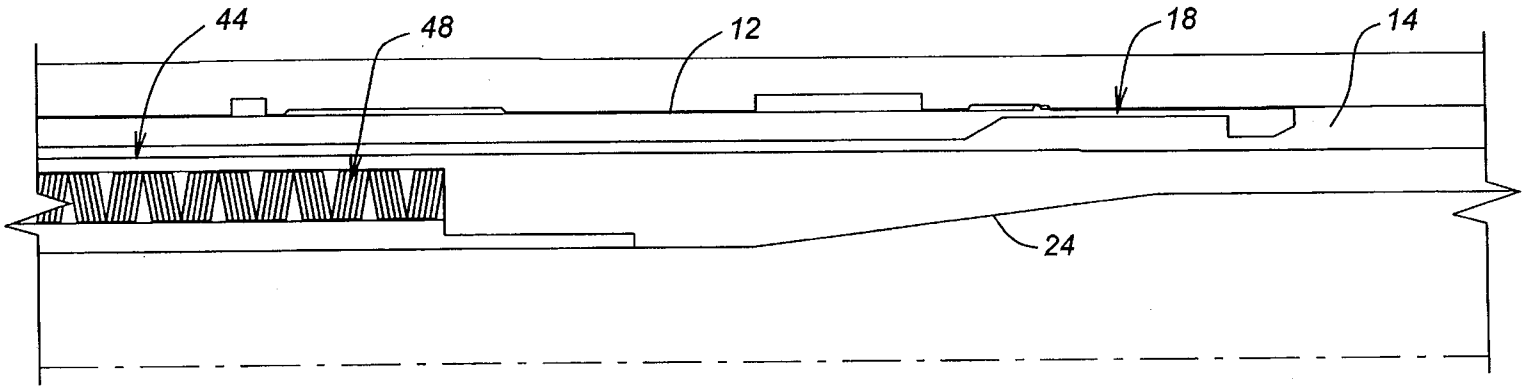
Figure 2A:
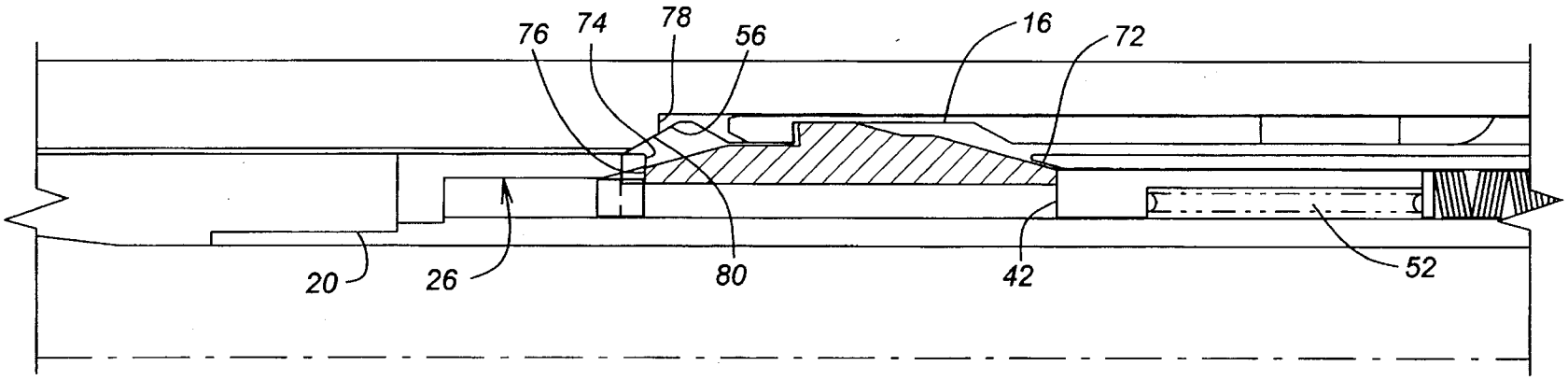
FIGS. 2*a* and 2*b* are the view of FIG. 1, with the tool shifted to expose the overpull key, allowing it to enter the groove in the shifting sleeve.
Figure 2B:
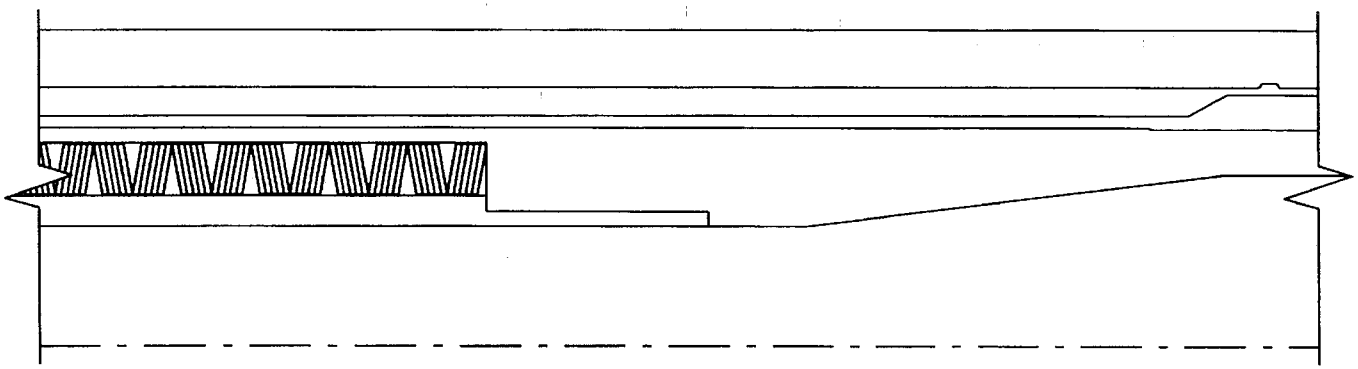
Figure 3A:
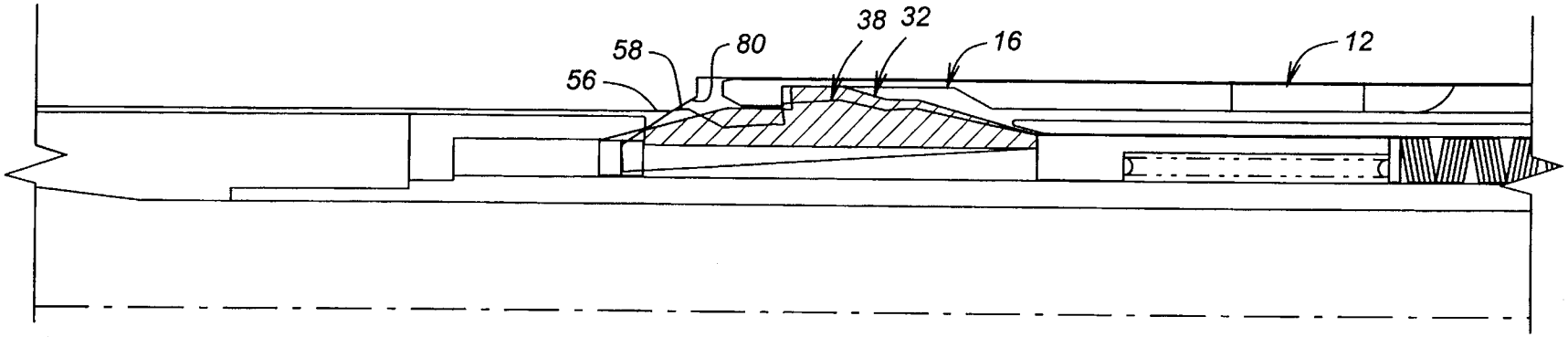
FIGS. 3*a* and 3*b* are the view of FIG. 2, showing the overpull key engaged in the sleeve and the shifting key being cammed out of the sleeve.
Figure 3B:
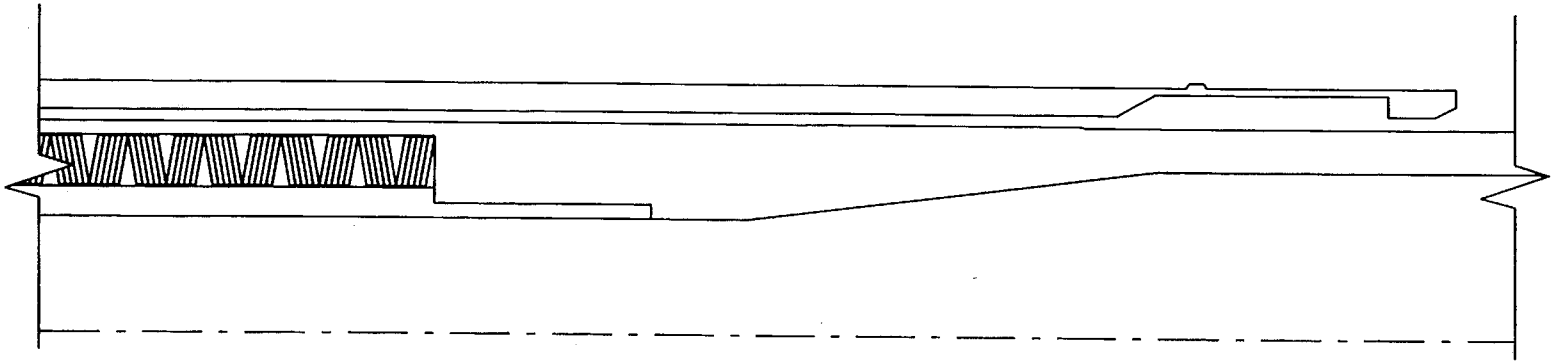

The main components of the apparatus A now having been described, its operation in shifting a sleeve 12 will now be discussed in more detail. As shown in FIGS. 1*a* and 1*b*, the apparatus A has been positioned adjacent groove 16. Since the shifting keys 38 have been biased outwardly by springs (not shown), surface 64 of the shifting keys 38 readily enters groove 16 while top end 70 of the shifting sleeve 12 enters the groove formed by surfaces 60, 62, and 64. An upward pull on the apparatus A will get the shifting sleeve from a lower position to the position shown in FIG. 1. In other words, the position shown in FIG. 1 shows the shifting sleeve 12 already shifted from a lower position to an upper position. FIG. 2 illustrates further upward pulling on the apparatus A through top sub 20. This acts to bring up top sub 20 along with upper retractor 26. At the same time, retrieving sleeve 44 moves upwardly to a point adjacent the window 42. Since during this upward pulling operation on top sub 20 surface 62 of the shifting keys 38 encounters resistance as sleeve 12 no longer moves upwardly, top sub 20, which is connected to body 22, which is in turn connected to bottom sub 24, which in turn is attached to the retrieving sleeve 44, all move up while key cage 40 remains stationary because surface 68 of shifting keys 38 engages the window 42. This can readily be seen by comparing FIG. 2*a* with FIG. 1*a*, where it can be seen that the spring 52 has been compressed while the tapered surface 72 moves up to encroach on window 42 without contact of either the shifting keys 38 or the overpull keys 32. At the same time, the upward movement of top sub 20 has retracted upper retractor 26 to the point where its lower end 74 is retracted beyond upper end 76 of overpull keys 32. As shown in the position of FIG. 2*a*, the overpull keys 32 are liberated to be biased radially outwardly by springs or by other means (not shown) into groove 16. As can also be seen by comparing FIG. 2*a* to FIG. 1*a*, there has been some movement of the sleeve 12 toward radial surface 78 of recess 14 such that tapered surface 56 of shifting keys 38 has made initial contact with tapered surface 80 adjacent radial surface 78. In essence, in the position shown in FIG. 2*a*, the sleeve 12 has traveled substantially the entire distance upwardly within the recess 14 and the overpull keys 32, as well as shifting keys 38, are fully in alignment and engaged in groove 16. Further upward pulling on top sub 20 cams the shifting keys 38 out of groove 16, as shown in FIG. 3*a*. As seen in FIG. 3*a*, surface 56 on the shifting keys 38 has already slid past tapered surface 80, while surface 58 is about to clear tapered surface 80. The sliding of surface 58 on tapered surface 80 cams the shifting keys 38 downwardly but leaves the overpull keys 32 still engaged in groove 16 of sleeve 12.

Figure 4A:
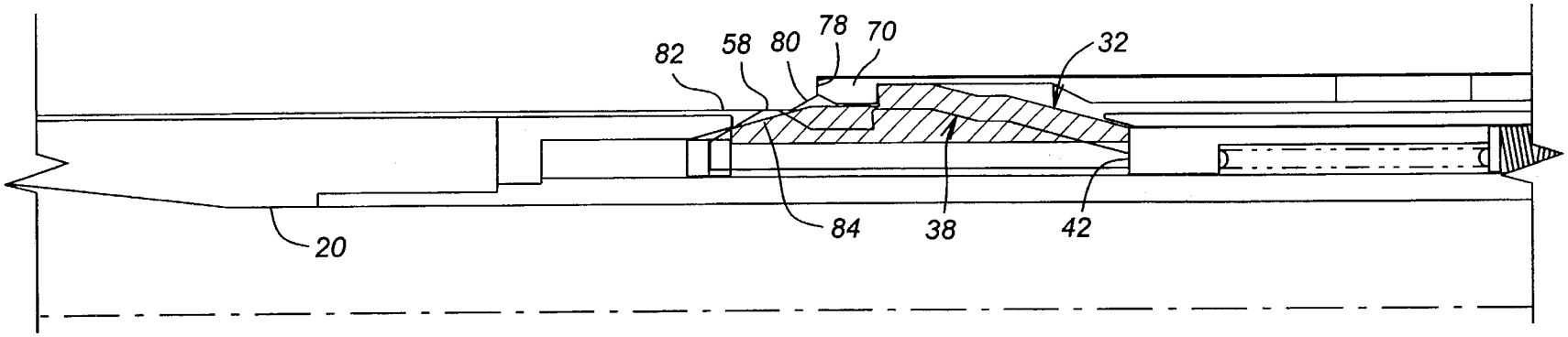
FIGS. 4*a* and 4*b* are the view of FIG. 3, showing the overpull key fully engaged and the shifting key disengaged from the shifting sleeve.
Figure 4B:
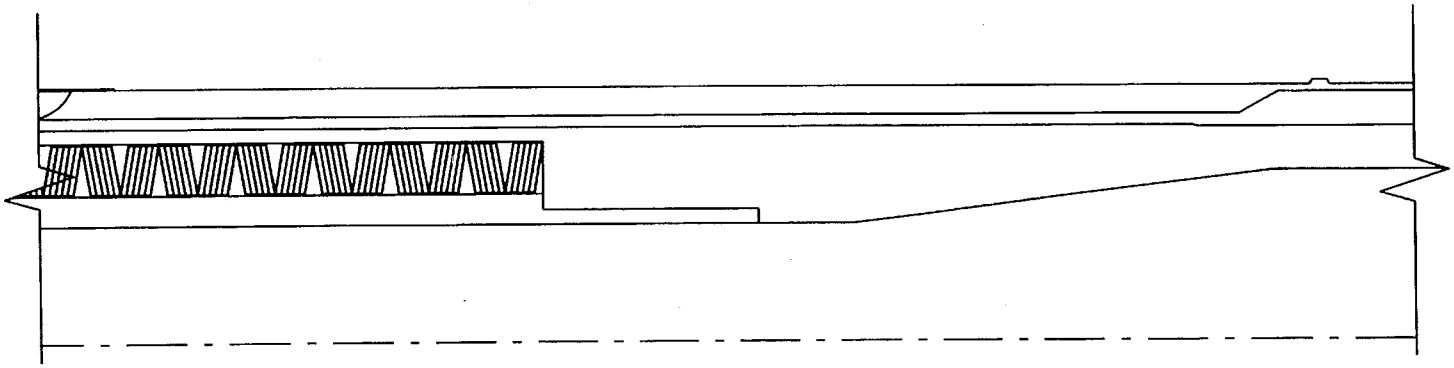
Figure 6A:
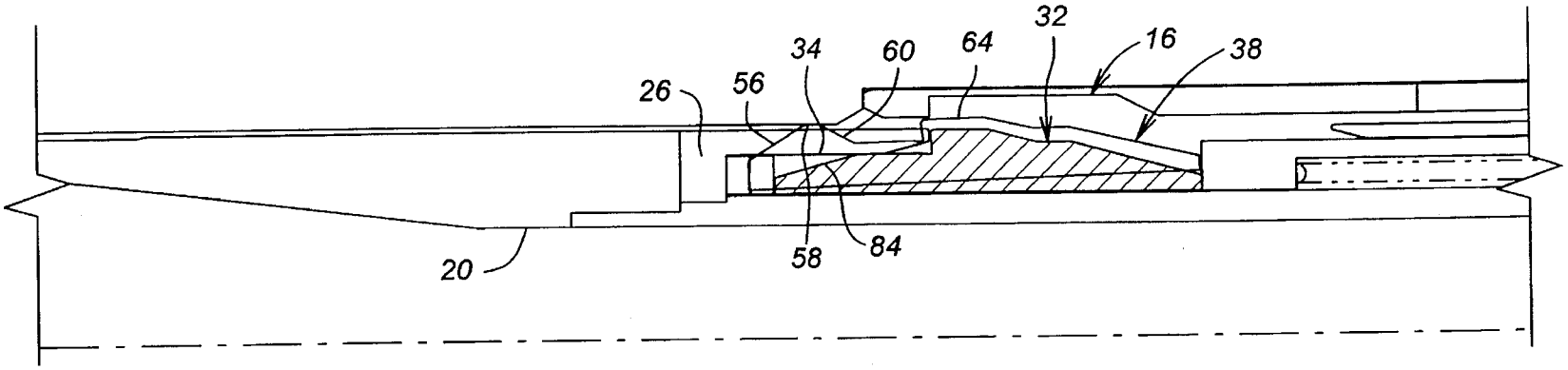
FIGS. 6*a* and 6*b* are the view of FIG. 4, showing a normal release in which the overpull key is prevented from entering the shifting sleeve and the position of the shifting sleeve prevents reengagement of the shifting key.
Figure 6B:
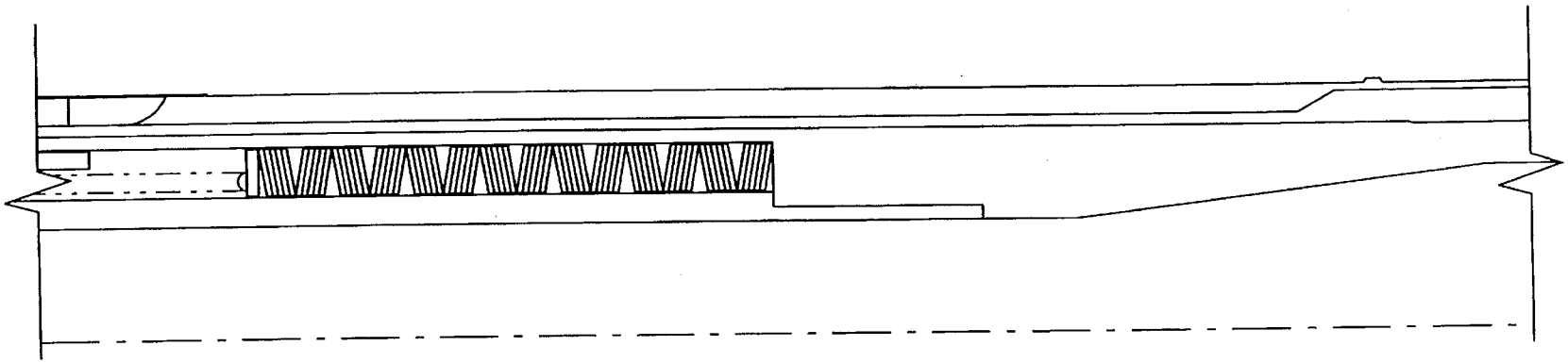

Now comparing FIG. 4*a* to FIG. 3*a*, it is seen that top end 70 has contacted radial surface 78 as a result of a force applied from the surface to top sub 20. In FIG. 4*a*, the shifting keys 38 are fully retracted within window 42 since surface 58 of shifting keys 38 has been cammed past tapered surface 80 and against rounded surface 82 of the tubular 10. A predetermined force (the "overpull"), of a magnitude which is preferably short of the force required to significantly alter the overall length of the assembled stack of Belleville washers 48, may then be applied. The operator or other surface personnel sense that a sufficient load has been applied for a given time and now have the beginning of the feedback that the sleeve 12 has shifted as far as it can go in recess 14. To confirm this information, the upward force on top sub 20 is released, as shown in FIG. 6. When the pulling force on top sub 20 is then converted to a let-down force, the upper retractor 26 moves downwardly with top sub 20 and, in effect, cams the overpull keys 32 as surface 34 moves longitudinally and interacts with tapered surface 84, in effect bringing down the overpull keys 32 out of groove 16. It should be noted by looking at FIG. 6*a* that the shifting keys 38 cannot re-enter groove 16 when the sleeve 12 has come between all the way up and a predetermined distance from radial surface 78. The reason for this is that the cam portion of the shifting keys 38, which comprises of surfaces 55, 58, and 60, cannot enter recess 14 due to such position of sleeve 12. The remaining configuration of the shifting keys 38 is such that unless the cam portion comprising surfaces 56, 58, and 60 can enter recess 14 above the sleeve 12, surface 64 cannot enter groove 16 to engage the sleeve 12. Accordingly, once the operator lets down on top sub 20, moving the shifting keys 38 below groove 16, and pulls back up, realizing that there has been no reengagement to groove 16, the feedback that is obtained is that the sleeve 12 has been fully shifted, and further downhole operations can proceed with the knowledge that the sleeve 12 is in an appropriate position.

Figure 5A:
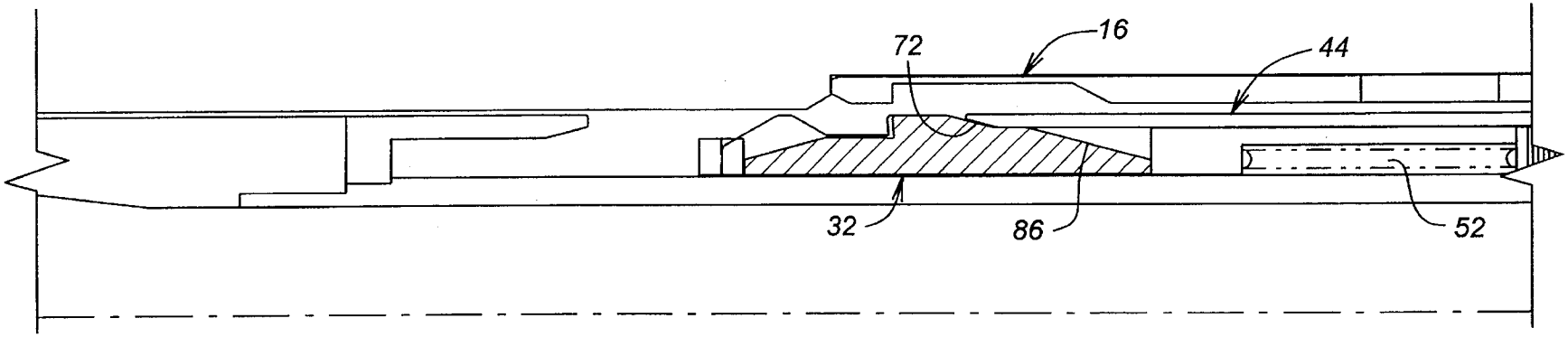
FIGS. 5*a* and 5*b* are the view of FIG. 4, showing an emergency release feature which cams the overpull key out of the shifting sleeve.
Figure 5B:
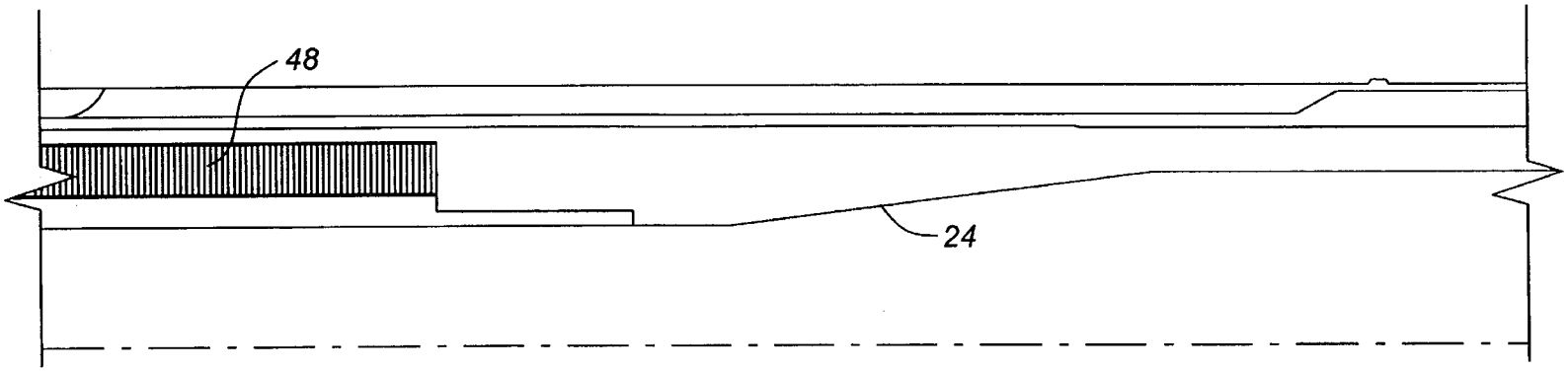

FIG. 5 illustrates the emergency release procedure. This is accomplished when sleeve 12 cannot be shifted further but shifting keys 38 have not been released due to camming of surface 56 on surface 80. The emergency release facilitates resettable release of sleeve 12, regardless of its position. To accomplish this, the level of upward pulling force on top sub 20 is increased to the point where the Belleville washers 48 are compressed. Once the washers 48 are compressed to shrink in overall dimension, the top sub 20 moves up proportionally, bringing up with it the bottom sub 24 as well as tapered surface 72 of retrieving sleeve 44. Tapered surface 72 cams the overpull keys 32 (and the shifting keys 38, should they still be engaged) downwardly by riding along their tapered surface 86, thus putting the overpull keys 32 in the final position shown in FIG. 5, where they are fully retracted out of groove 16. In all these embodiments, the shifting keys 38 can be dimensioned so that even though they are no longer engaged in groove 16, tapered surface 72 still cams them further downwardly. As soon as the position shown in FIG. 5 is attained, the stored forces in Belleville washers 48, as well as spring 52, push the overpull keys 32 uphole towards upper retractor 26 where they end up in the final position which is shown in FIG. 1*a*. The apparatus A, in this as well as the other embodiments, is now recocked in the run-in position for another grab of the sleeve 12 either in the same or opposite direction, or to move to another sleeve without taking the apparatus A out of the wellbore. It can also be removed from the well.

An alternative embodiment is shown in FIGS. 7–12. The sequence of operation is the same as illustrated in FIGS. 1–6; however, the differences in the component construction will be described in more detail. Where the components serve the same function, they will be given the same number, with a designation of prime to indicate which alternative embodiment is being discussed.

Figure 7A:
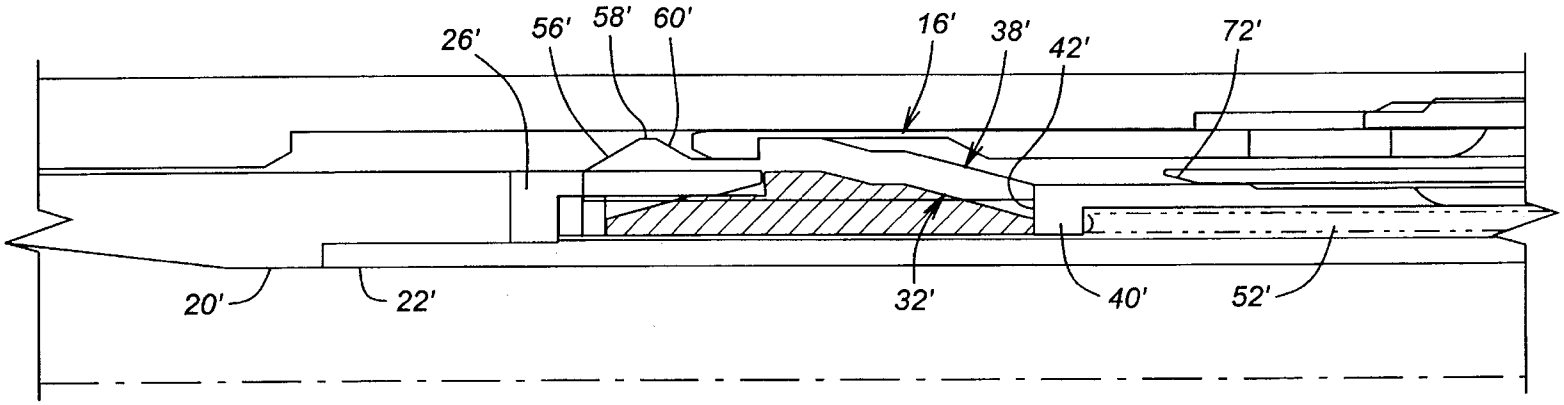
FIGS. 7*a* and 7*b* are an alternative embodiment in the run-in position, similar to that shown in FIG. 1.
Figure 7B:
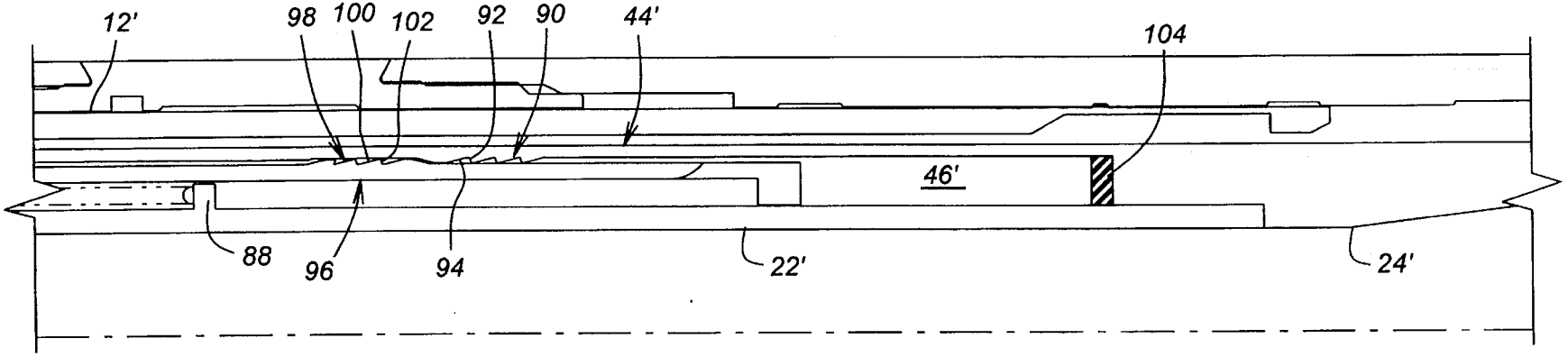

In comparing the embodiment of FIG. 7 to the embodiment of FIG. 1, the principal differences are that the body 22' has a shoulder 88 which supports spring 52' on one end. The other end of spring 52' bears on key cage 40'. The retrieving sleeve 44' has a series of teeth 90, with a typical tooth having surfaces 92 and 94. The key cage 40' has a series of cantilevered collets 96, which have teeth 98. A typical tooth 98 has surfaces 100 and 102. At the end of annular cavity 46' is a shock absorber 104, which is typically a piece of nitrile rubber.

Referring now to the operation of the embodiment shown in FIGS. 7–12, the shifting keys 38' are biased outwardly by springs (which are not shown) so that they engage the groove 16' of the shifting sleeve 12'. Eventually, the shifting keys 38' move the shifting sleeve 12' upwardly to the position as shown in FIG. 7. Thereafter, further upward pulling on the top sub 20', with the shifting sleeve 12' resisting upward movements, results in upward movement of top sub 20' along with the upper retractor 26', thereby liberating the overpull keys 32', as shown in FIG. 8*a*.

At this point, both the shifting keys 38' and the overpull keys 32' are lodged inside the groove 16' of the shifting sleeve 12'. With the upward movement of top sub 20', body 22', and bottom sub 24', the teeth 90 on retrieving sleeve 44' move upwardly with respect to key cage 40' such that eventually, teeth 90 ride over and interengage with teeth 98. This riding over is possible because the retrieving sleeve 44' is a cylindrical structure interacting with the cantilevered collets 96, which are cut out of key cage 40'. However, up until there is engagement between teeth 90 and teeth 98, as shown in FIG. 2*b*, upward pulling on top sub 20' results in a force on shoulder 88, which compresses spring 52'. Upon interengagement of teeth 90 and 98, further relative movement of sleeve 44' with respect to cage 40' is temporarily halted.

Figure 8A:
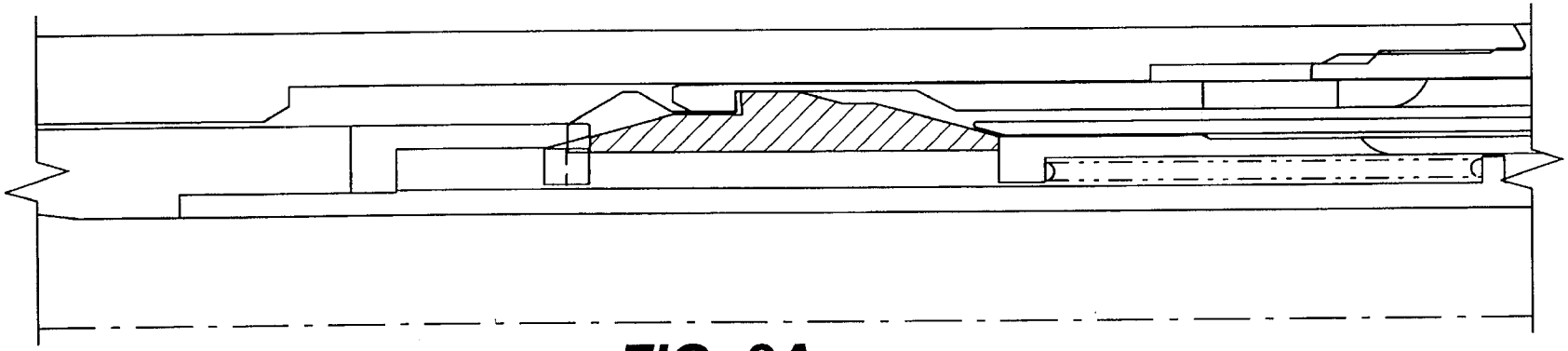
FIGS. 8*a* and 8*b* are the tool of FIG. 7, illustrating release of the overpull key.
Figure 8B:
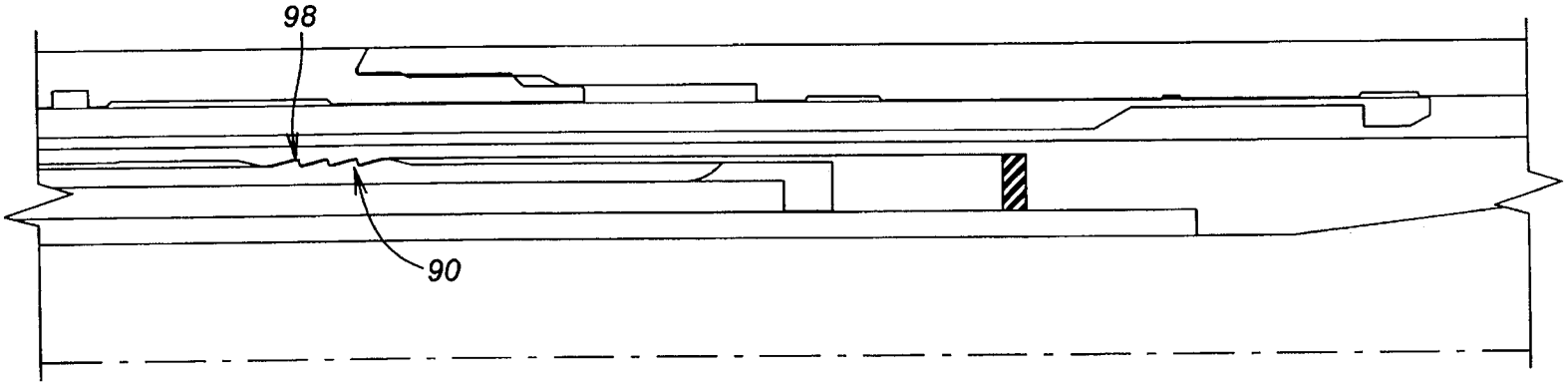
Figure 9A:
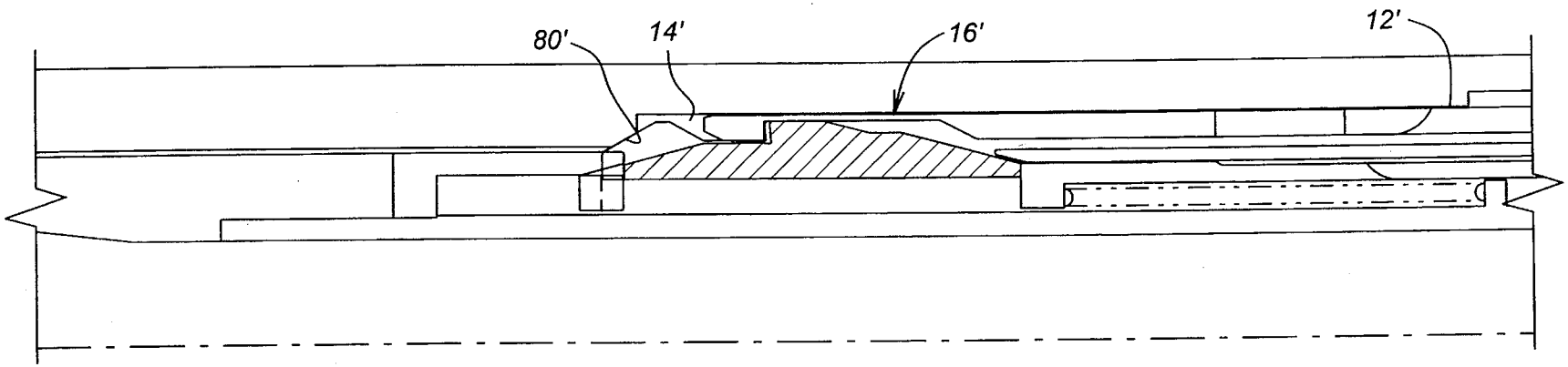
FIGS. 9*a* and 9*b* are the view of FIG. 8, illustrating the onset of camming of the shifting key out of the sleeve.
Figure 9B:
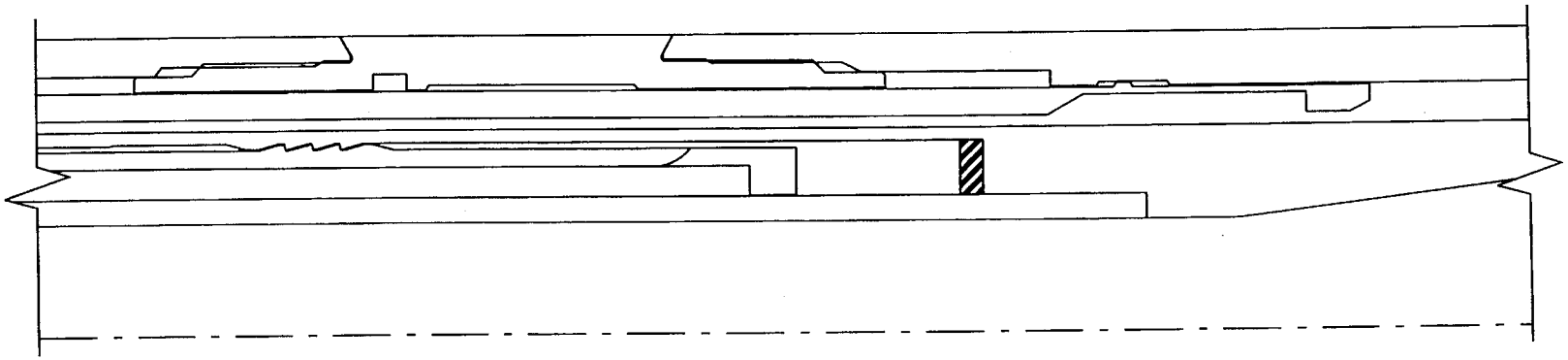
Figure 10A:
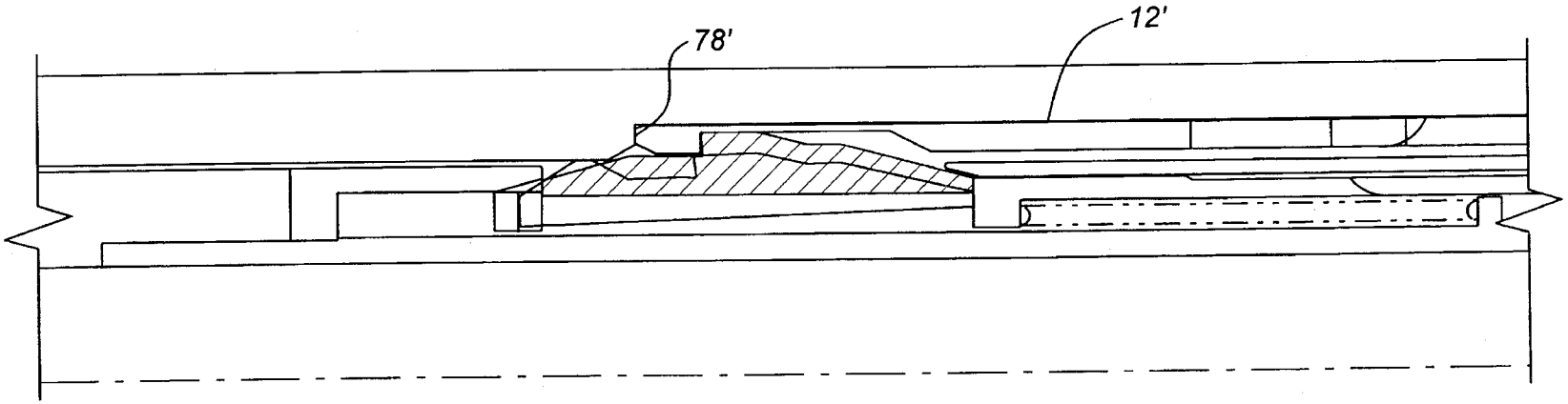
FIGS. 10*a* and 10*b* are the view of FIG. 9, showing the overpull key fully engaging the sleeve.
Figure 10B:
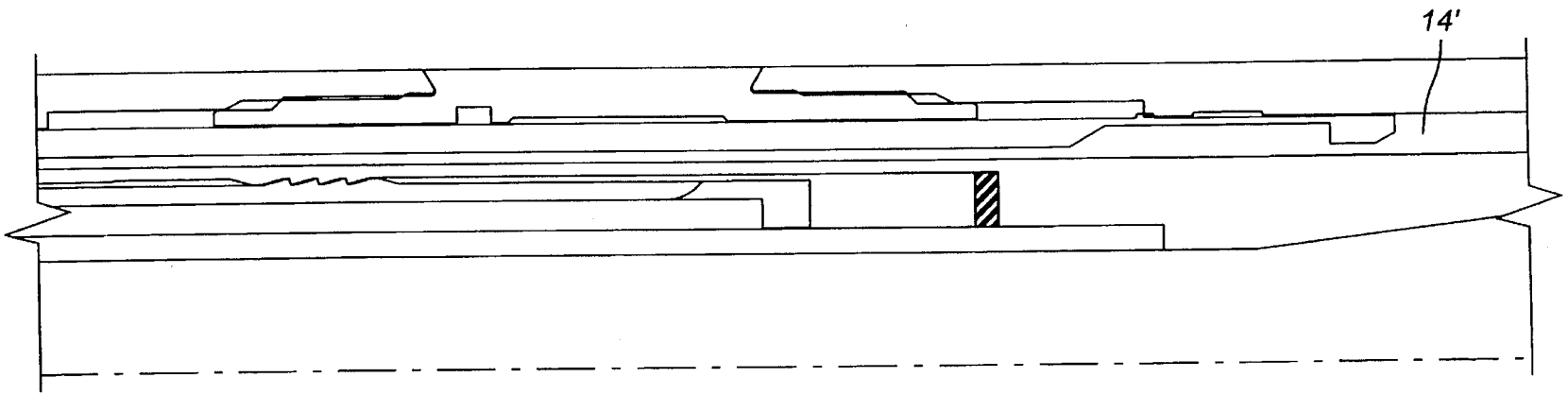

In essence, the initial distance between teeth 90 and 98 is the distance that spring 52' is compressed by shoulder 88. The end of the motion occurs when there is engagement between teeth 98 and 90, as shown in FIG. 8*b*. Subsequent upward pulling on top sub 20', as shown in FIG. 9*a*, shifts the sleeve 12' upwardly further within the recess 14' so as to engage surface 56' on taper 80' as shown in FIG. 9*a*. At this point, any further upward movement of the sliding sleeve 12' cams the shifting keys 38' out of groove 16', as illustrated in FIG. 10*a*. At this point, the overpull keys 32' continue to be engaged in the groove 16' and a predetermined overpull force can be applied. This application of a predetermined force ensures that the sliding sleeve 12' travels the remaining distance within the recess 14' until it engages radial surface 78'. It should be noted that the sleeve 12' need not travel completely up to radial surface 78' as long as it gets sufficiently close to such surface that the cammed portion, i.e., surfaces 56', 58', and 60', can no longer insert itself into recess 14' above the sleeve 12'.

Figure 12A:
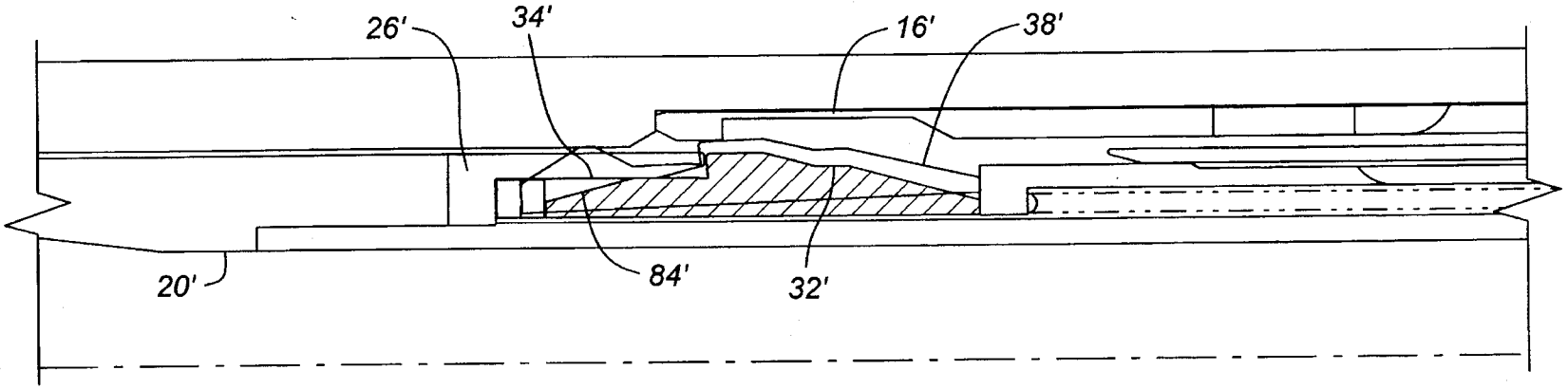
FIGS. 12*a* and 12*b* are the view of FIG. 10, showing the normal release of the overpull key which results in trapping the overpull key and prevention of the shifting key from reengagement with the sleeve.
Figure 12B:
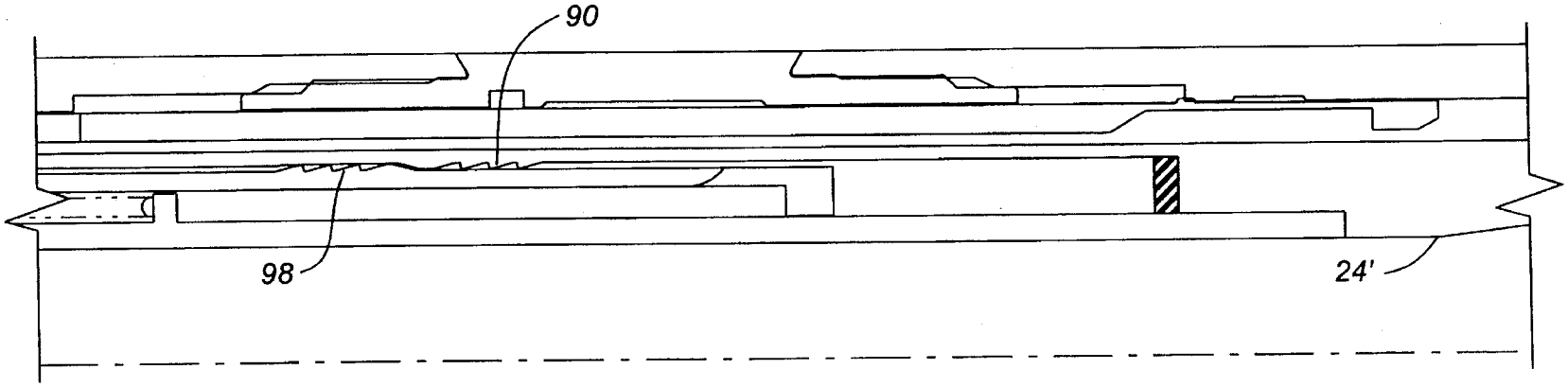

In the example shown in FIG. 10*a*, the sleeve 12' has moved fully in recess 14' up to radial surface 78'. After a sufficient upward pulling force is recorded by the operator or other surface personnel, the release sequence in normal operation is illustrated in FIG. 12. At that point, the pulling force on top sub 20' is removed and weight is set down on top sub 20'. This drives down the upper retractor 26' and results in surface 34' engaging ramped surface 84' on overpull keys 32' to ramp them downwardly and away from groove 16', as shown in FIG. 12*a*. As previously stated, the shifting keys 38' cannot reenter the groove 16' due to sleeve 12' having shifted up to radial surface 78'. Accordingly, the operator then lowers the apparatus and if it does not reengage upon raising it, the feedback is that the shifting sleeve 12' has shifted all the way.

In order to accomplish the disengaging feature of the overpull keys 32', the act of setting down weight on top sub 20' drives down bottom sub 24', which in turn pulls teeth 90 away from teeth 98. Those skilled in the art can see that the orientation of teeth 90, comprising of surfaces 92 and 94, is such that there is no interengagement with teeth 98, which comprise surfaces 100 and 102, when weight is set down on top sub 20'. Instead, the teeth 90 and 98 ratchet over each other to easily disengage. The reverse, however, is not true. An upward pulling force on top sub 20' results in meshing of teeth 90 and 98 to resist the upward forces to a predetermined limit.

Figure 11A:
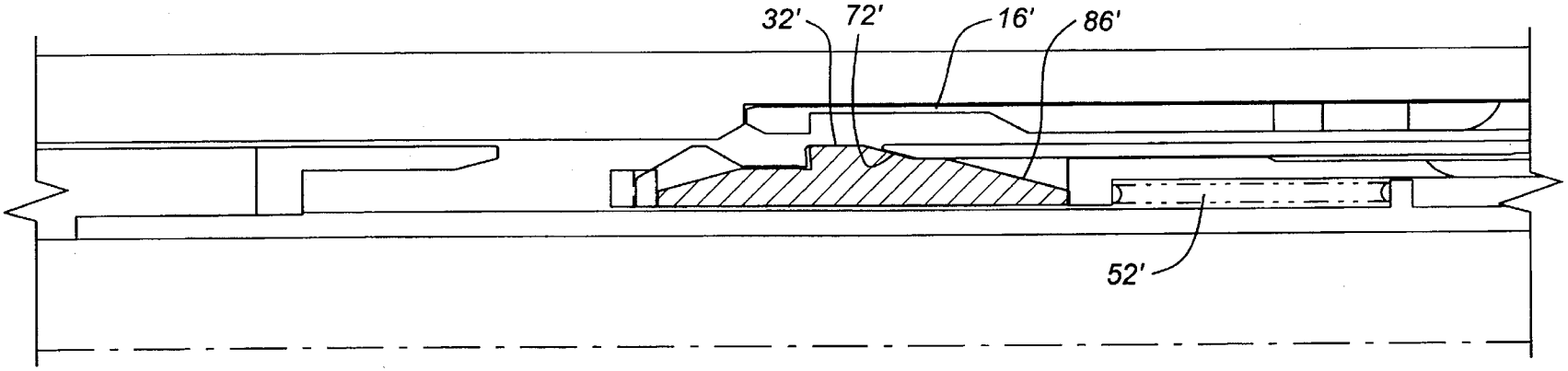
FIGS. 11*a* and 11*b* the view of FIG. 10, showing an emergency release of the overpull key via disengagement of cantilevered collets.
Figure 11B:
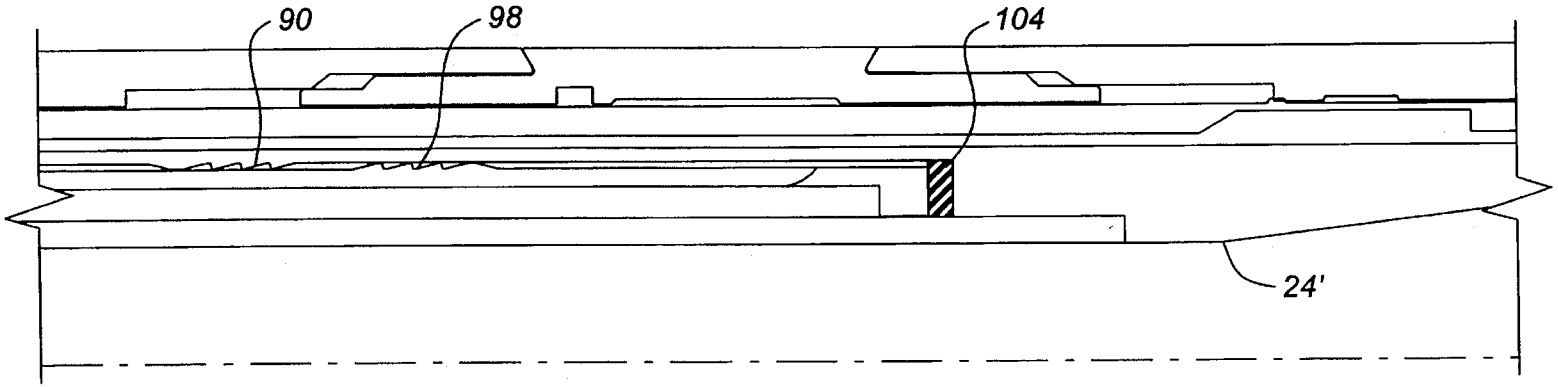

Once that predetermined limit of resistance to upward pulling by the meshed teeth 90 and 98 is reached, the emergency release feature illustrated in FIG. 11 occurs. The emergency release feature functions when the operator or other surface personnel exceeds a predetermined upward force on the top sub 20'. When that occurs, the cantilevered collets 96 are flexed inwardly as teeth 90 ride over teeth 98, the overpull keys 32' (and the shifting keys 38', if they are still in groove 16') are cammed out of groove 16' when tapered surface 72' rides on ramped surface 86', effectively retracting the overpull keys 32'.

As the teeth 90 and 98 disengage, the bottom sub 24' moves up quickly, bringing the shock absorber 104 into contact with key cage 40'. At the same time, the camming of the overpull keys 32' allow spring 52' to advance the overpull keys 32' from the position shown in FIG. 11*a* to the position shown in FIG. 12*a*. This occurs as teeth 98 ratchet past teeth 90 to assume the position shown in FIG. 12. The apparatus A resumes its run-in position where the emergency release feature is recocked in the run-in position to allow another grab of the sleeve 12 either in the same or opposite direction, or to move to another sleeve without pulling out of the hole. It can also be removed from the well.

The embodiment shown in FIGS. 13–18 is similar to the embodiment shown in FIGS. 7–12, except the engagement of teeth 90 and 98 is eliminated and instead, the upper retractor 26" has built into it a left-handed square thread 106, while the key cage 40" features a cantilevered collet 108, which has a matching square thread 110. The collet 108 is movable within a groove 112 on key cage 40". A shoulder 114 extends from body 22" and acts as a travel stop for the key cage 40". The spring 52" bears against key cage 40" to push it up against shoulder 114 in the run-in position. Otherwise, the parts of the embodiment of FIGS. 13–18 are similar or function similarly to the previous two embodiments described.

Figure 13A:
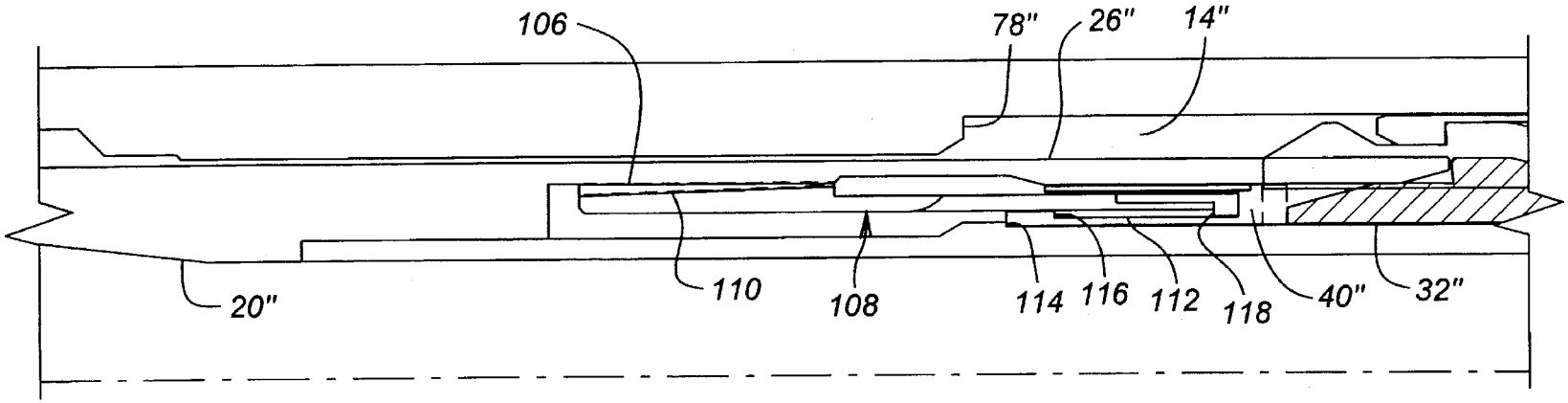
FIGS. 13*a* and 13*b* are the run-in position of an alternative embodiment of the invention, showing the shifting key engaged to the shifting sleeve.
Figure 13B:
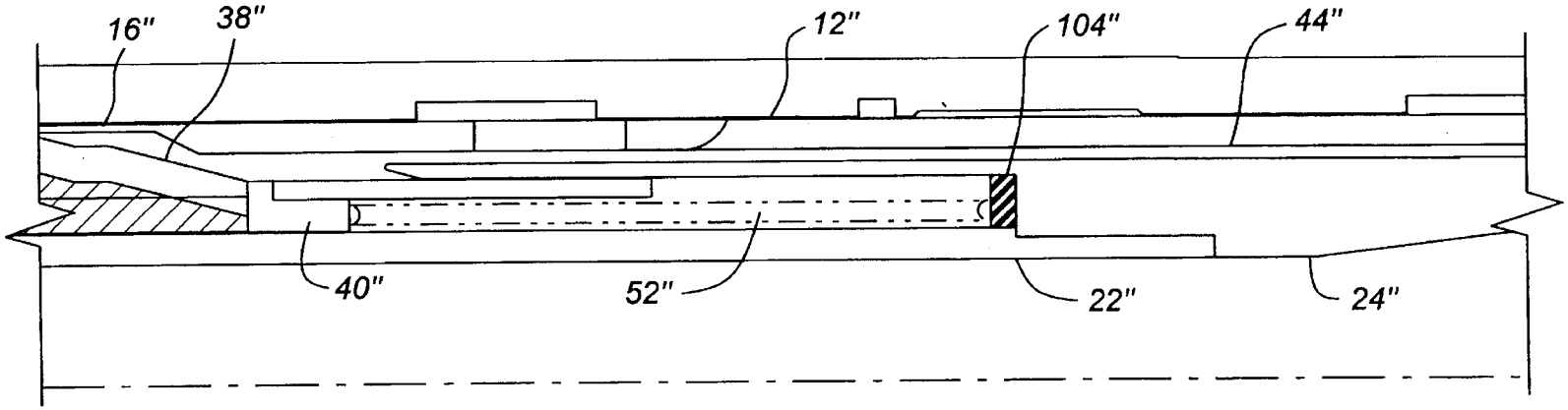
Figure 14A:
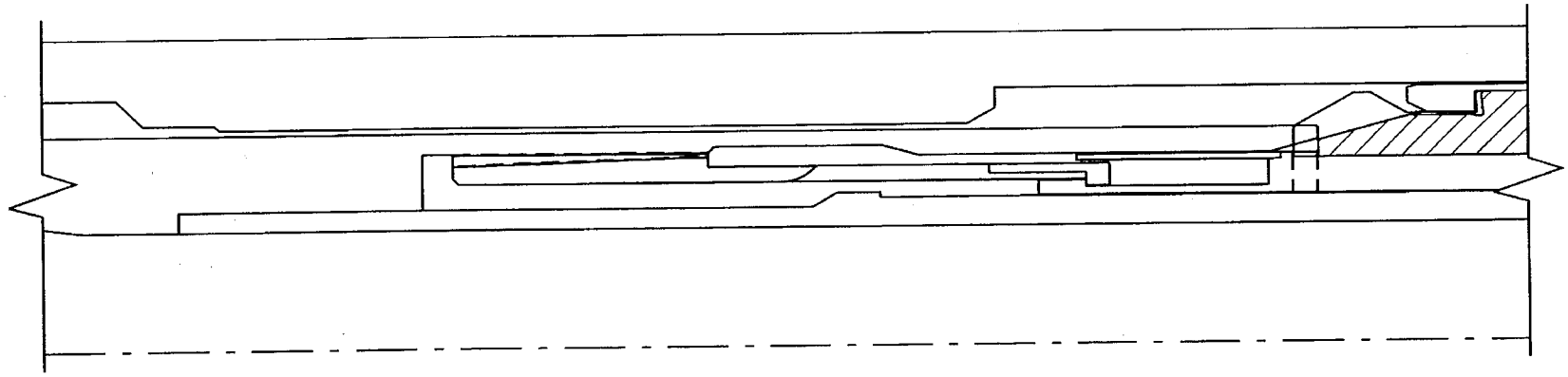
FIGS. 14*a* and 14*b* are the view of FIG. 13, with the overpull key released to engage the sleeve.
Figure 14B:
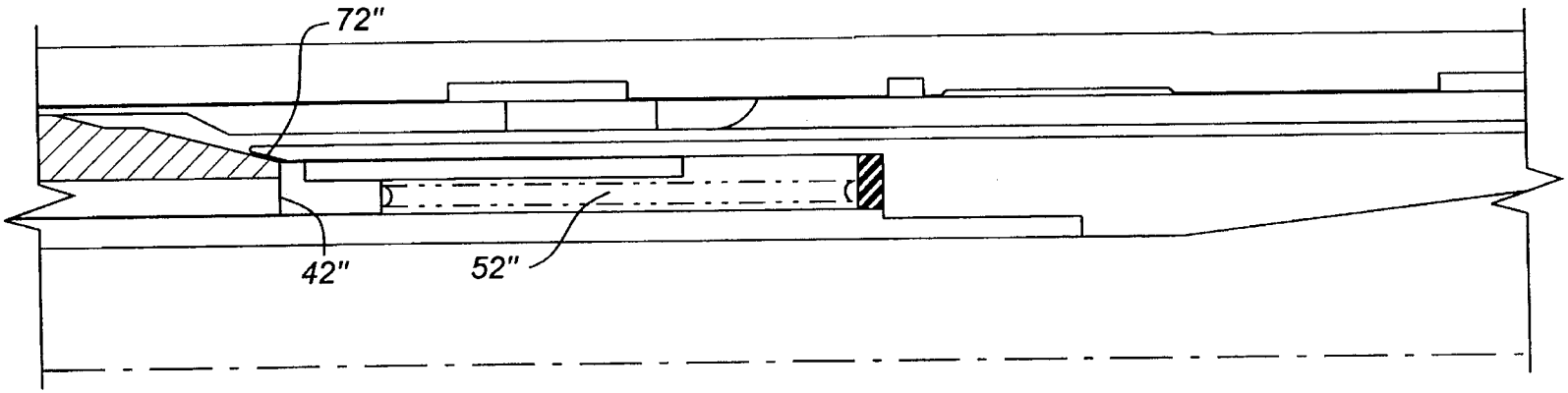

In operation, as to the embodiment of FIGS. 13–18, the shifting key 38" is engaged in groove 16" to move the sleeve 12" upwardly to the position shown in FIG. 13*a*. At that point, some resistance is encountered to further movement of sleeve 12". Further upward pulling forces exerted on top sub 20" retracts the upper retractor 26", liberating the overpull keys 32" to enter the groove 16", as shown in FIG. 14. Subsequent further upward pulling on top sub 20" brings surface 56" on the shifting keys 38" into contact with tapered surface 80". By comparing FIGS. 15 and 16, it can be readily seen that any further upward pulling of top sub 20" cams the shifting keys 38" out of groove 16", leaving the overpull keys 32" remaining in groove 16".

It should be noted that the pulling on the top sub 20", in order to retract the upper retractor 26", results in compression of spring 52" since the shifting keys 38" are lodged within groove 16", yet at the same time the assembly connected to top sub 20" is moving upwardly. As before, tapered surface 72" moves adjacent the window 42", while the overpull keys 32" are liberated. While this movement is going on and top sub 20" is being moved up, square thread 106 is engaged to thread 110 on collet 108, thus dragging up collet 108 within groove 112, as can be seen by comparing FIGS. 13 and 14. Groove 112 has a shoulder 116 which, when engaged by surface 118, stops any relative movement between the collet 108 and body 22". This position is illustrated in FIG. 14*a*.

Figure 15A:
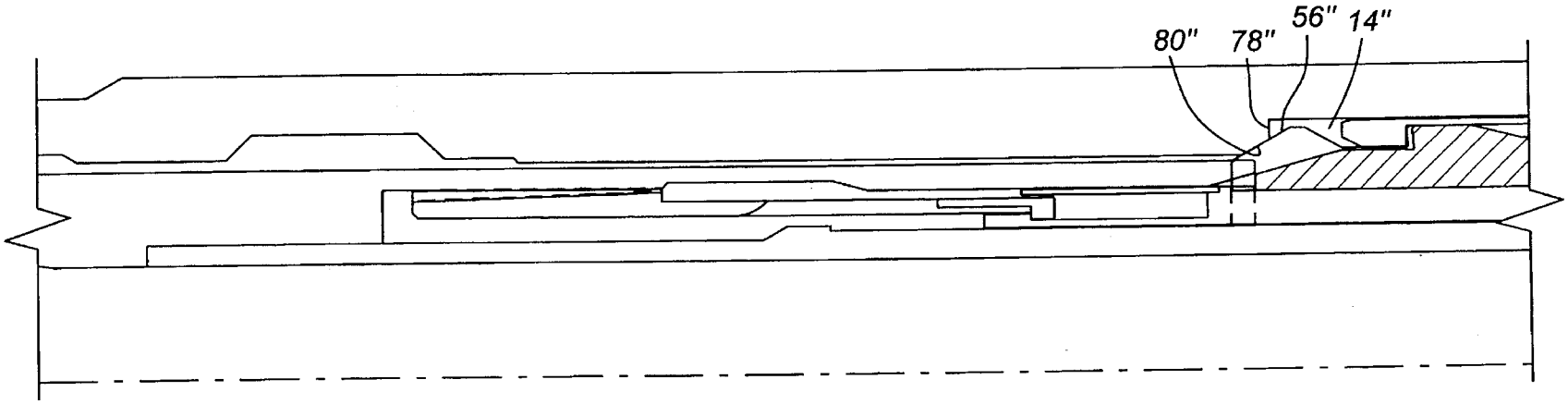
FIGS. 15*a* and 15*b* are the view of FIG. 14, with the overpull key engaged to the sleeve and the shifting key about to be cammed out of the sleeve.
Figure 15B:
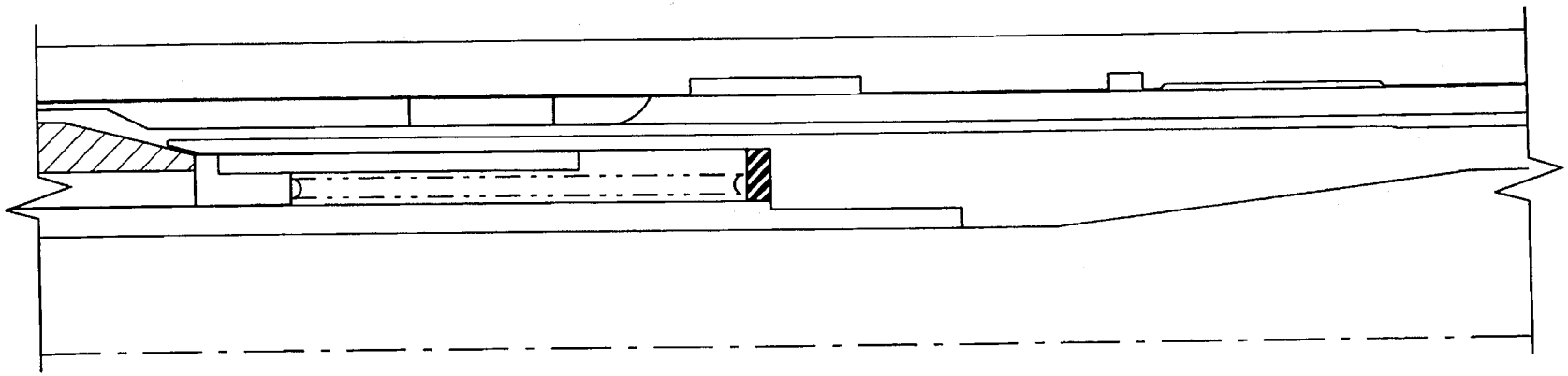

As previously stated, a further upward pulling force on top sub 20" shifts the connected assembly of square thread 106 and thread 110 upwardly as upper retractor 26" moves up with top sub 20". By the time that surface 118 hits shoulder 116, the upper retractor 26" has moved up sufficiently to liberate the overpull keys 32", as shown in FIG. 15.

Figure 16A:
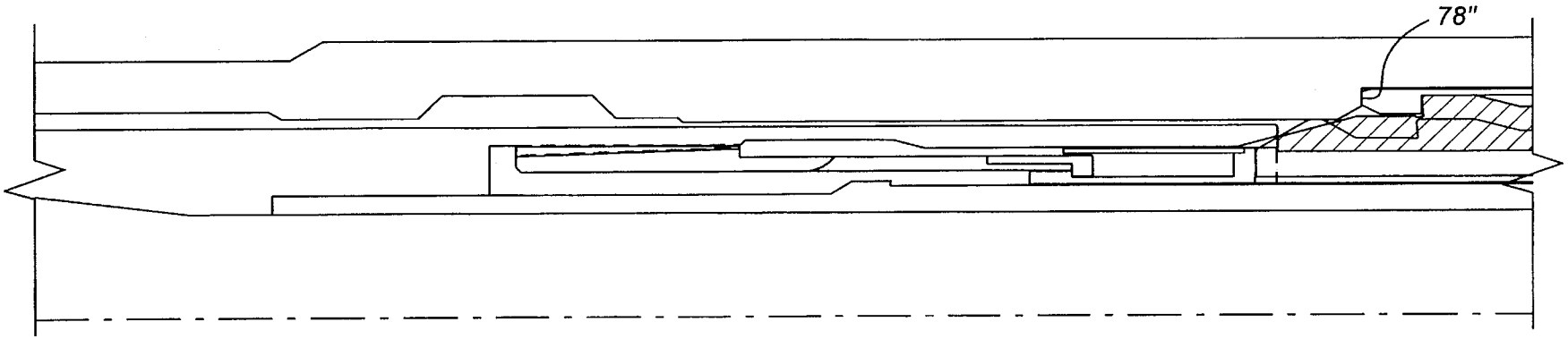
FIGS. 16*a* and 16*b* are the view of FIG. 15, showing the shifting key fully released and the overpull key engaged.
Figure 16B:
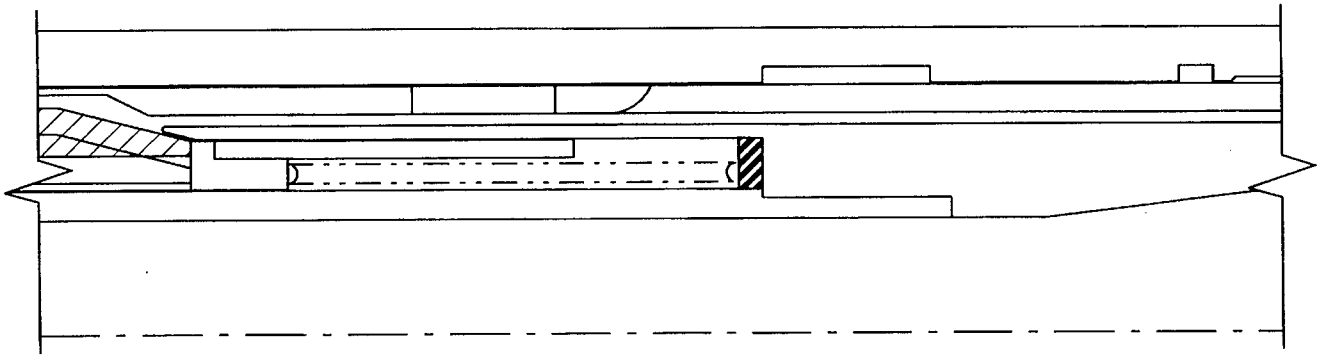

The overpulling can then commence, as illustrated in FIG. 16, where a predetermined force, short of a force to engender separation of square thread 106 from thread 110, can be applied and viewed on an indicator or recorded at the surface. It should be noted that as a result of the application of the overpulling force as shown in FIG. 16, the sliding sleeve 12" moves up further in recess 14" until it engages radial surface 78". Again, as previously stated, the shifting keys 38" cannot reenter the groove 16" when insufficient space in recess 14" exists between sliding sleeve 12" and radial surface 78".

At the conclusion of the application of the overpulling force, as illustrated in FIG. 16, the overpulling force is removed and weight is set down on top sub 20". At this point, surface 34" ramps along tapered surface 84" as upper retractor 26" moves downwardly. After sufficient downward movement, the overpull keys 32" are ramped out of groove 16". As previously stated, the shifting keys 38" cannot reenter the groove 16". This is confirmed at the surface by further letting down on top sub 20" and picking up again. If the apparatus A comes out of the hole without reengaging the groove 16", then the feedback is complete and the surface personnel know that the sleeve 12" has shifted fully. It should be noted that as soon as the overpull keys 32" are cammed by the upper retractor 26", spring 52" expands to maintain pressure on key cage 40" to keep it in the position shown in FIG. 18.

Figure 17A:
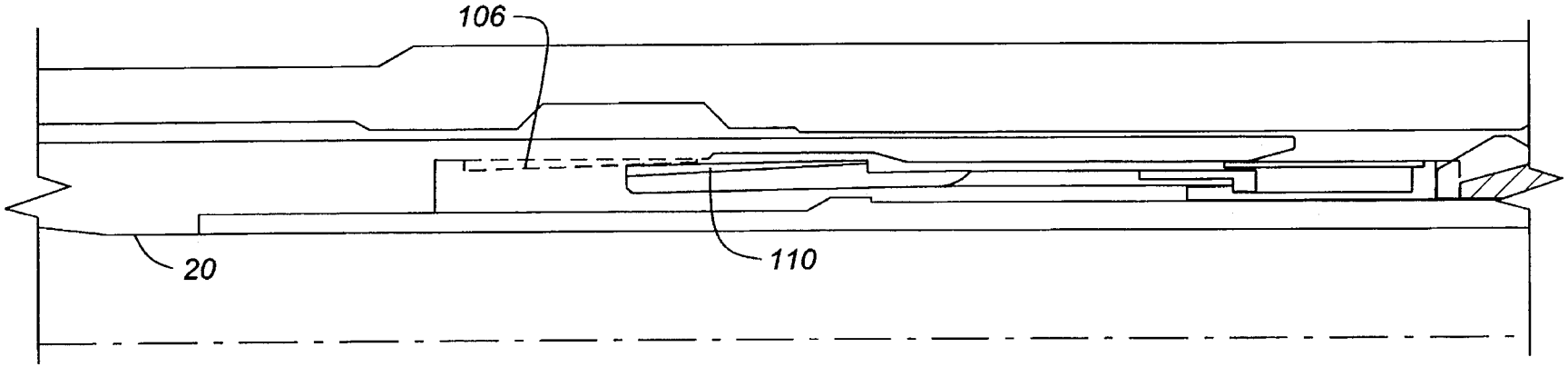
FIGS. 17*a* and 17*b* are the view of FIG. 16, showing the emergency release feature by a collet disengagement which results in camming the overpull key from the shifting sleeve.
Figure 17B:
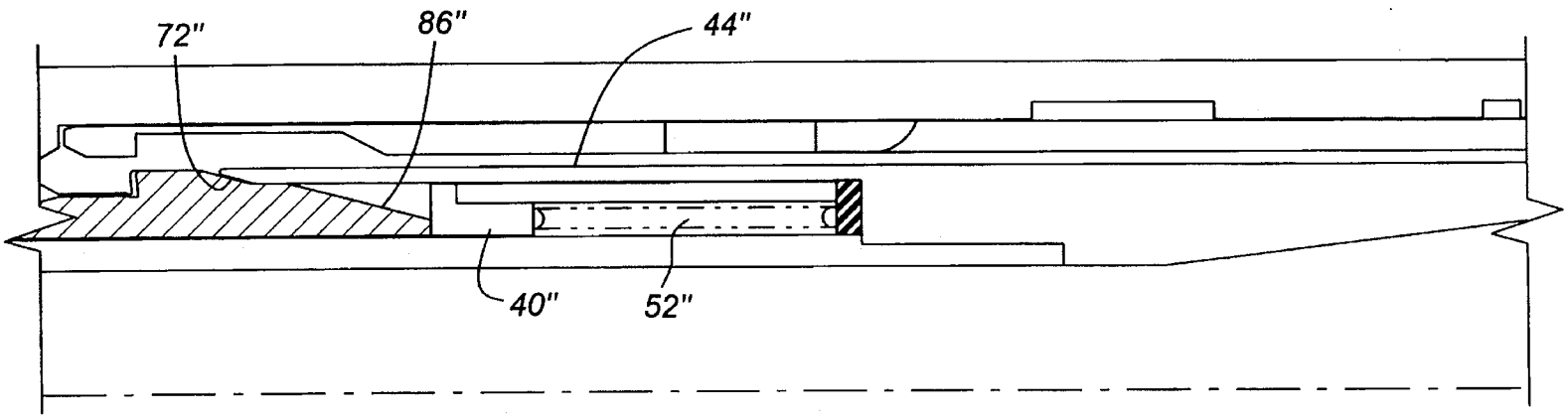
Figure 18A:
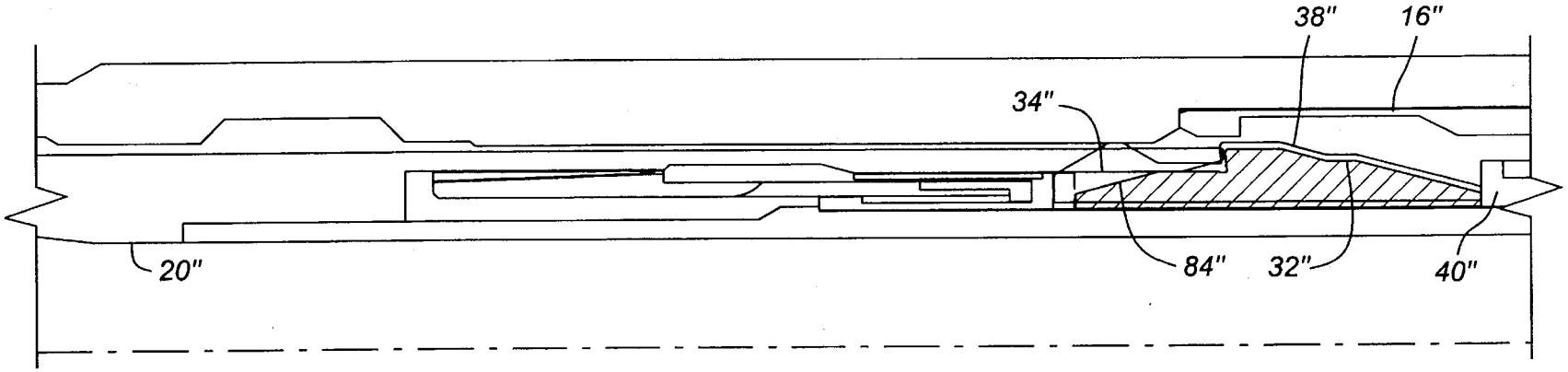
FIGS. 18*a* and 18*b* illustrate the normal release position wherein the overpull key is trapped and the shifting key cannot exit due to the position of the shifting sleeve.
Figure 18B:
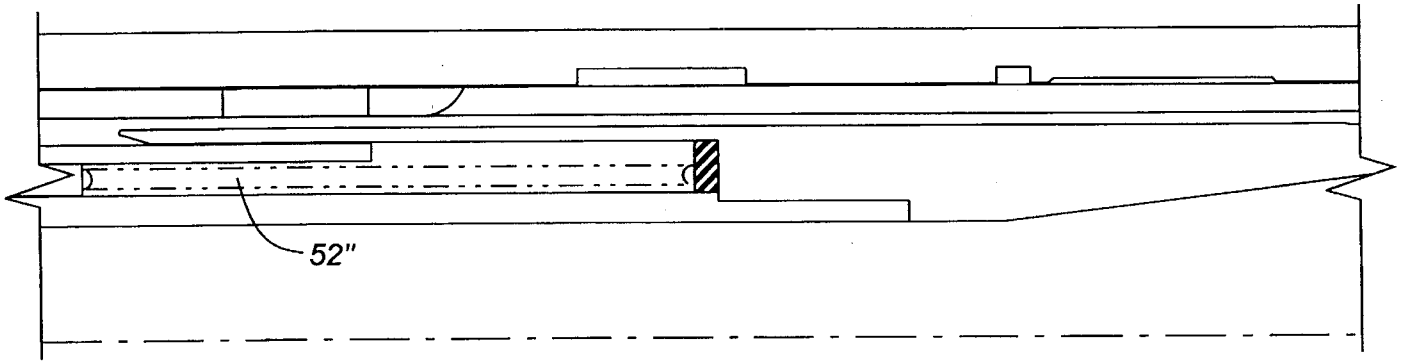

As previously stated, an emergency release is also possible which is illustrated in FIG. 17. If an emergency release is desired, the overpulling force is increased to the point where the force becomes so great that a separation ensues between square thread 106 and thread 110. When this occurs, the retrieving sleeve 44", having at its leading end tapered surface 72", cams the overpull keys 32" (and the shifting keys 38", if they are still engaged in groove 16") by ramping downwardly tapered surface 86" into the position shown in FIG. 17. By the time tapered surface 72" has ridden down tapered surface 86", the overpull keys 32" are fully retracted from the groove 16". At that point, spring 52" urges the key cage 40" upwardly until threads 110 rejoin and remate with threads 106 and the position of FIG. 18 is assumed. The apparatus A resumes its run-in position where the emergency release feature is recocked in the run-in position to allow another grab of the sleeve 12 either in the same or opposite direction, or to move to another sleeve without pulling out of the hole. It can also be removed from the well.

The embodiments illustrated in FIGS. 19–24 and 25–30 employ similar concepts but a somewhat different mechanical execution than the first three embodiments described. Again, where there is an overlap in parts, numbers previously used will be repeated, and new components will be assigned new numbers.

Referring now to FIGS. 19–24, it is seen that each of these figures is a split view overlying the overpull keys 32''' on top and the shifting keys 38''' on the bottom. When assembled as shown in the section view of FIG. 31, the preferred embodiment has the shifting keys 38''' offset by 45° from the overpull keys 32'''. Other configurations of the shifting keys and overpull keys can be used without departing from the spirit of the invention.

Figure 19C:
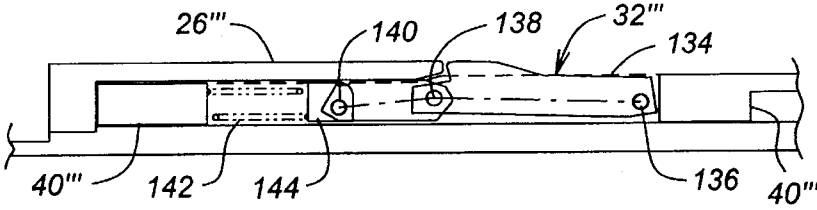
FIGS. 19*a* and 19*b* and 19*c* are an alternative embodiment of the invention, showing the run-in position with the shifting key engaged and the overpull key trapped.
Figure 19A:
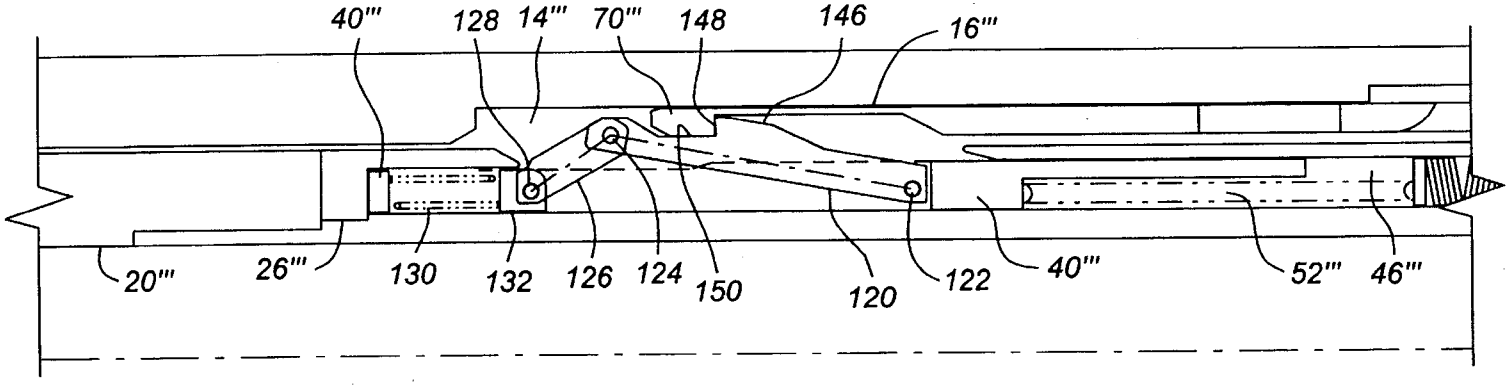
Figure 19B:
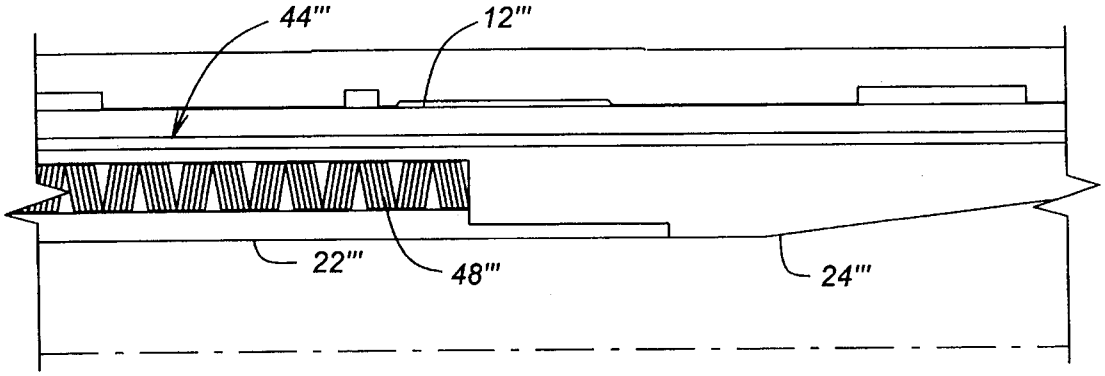

In this particular embodiment, the biggest differences are the actual construction of the shifting keys 38''' and the overpull keys 32'''. Referring to FIG. 19, the shifting keys 38''' consist of a link 120, which is pivotally mounted to key cage 40''' at pin 122. At the other end of link 120 there is a pin 124 to connect link 120 pivotally to link 126. Link 126 is pivotally connected to key cage 40''' at pin 128. A spring 130 is connected to follower 132 and cage 40''' which bears against upper retractor 26''' in the run-in position shown in FIG. 19. At the same time that the shifting keys 38''' are in the position shown in FIG. 19, extended into groove 16''', the overpull keys 32''' are retained by upper retractor 26'''. The structure of the overpull keys 32''' is similar to the structure of the shifting keys 38'''. Referring now to FIG. 19, it can be seen that the overpull keys 32''' comprise a link 134 pinned to key cage 40''' at pin 136. Link 134 is connected to link 136 at pin 138. Link 136 is connected to key cage 40''' at pin 140. Spring 142 bears on cage 40''' and follower 144 and is secured thereto. Cage 40''' in the run-in position of FIG. 19 butts up against the upper retractor 26'''.

All the significant parts of the embodiment of FIGS. 19–24 have now been described, and the operation will now be reviewed. In the run-in position, the upper retractor 26''' spans over link 136, effectively preventing link 136 from pivoting outwardly about pin 140, thereby aligning link 134 parallel with link 136. This effectively keeps the overpull keys 32''' from moving outwardly by rotational movements described into groove 16''' of the shifting sleeve 12'''.

At the same time, during the run-in position shown in FIG. 19, key cage 40''' is biased by spring 52''' to push longitudinally on link 120 through pivot 122. In the relaxed position, pin 124 normally extends radially outwardly further than pin 122 such that longitudinal movement of pin 122 encourages clockwise rotation of link 120, raising pin 124 while at the same time rotating link 126 in a counterclockwise manner about pin 128.

Link 120 has a unique shape which includes surfaces 146, 148, 140, 152, and 154. Surfaces 148, 150, and 152 form a depression into which top end 70''' enters. Surfaces 146, 148, and 150 form a protrusion which enters the groove 16''', as shown in FIG. 19. It should be noted that surface 150 is oriented with respect to the longitudinal axis of link 120 in an oblique manner so that upon the predetermined clockwise rotation of link 120, surface 150 presents itself substantially parallel to surface 156 at the top end 70''' of the sliding sleeve 12'''. In essence, despite the fact that rotation is accomplished to orient the link 120 in engagement with the sliding sleeve 12''', the physical engagement of the groove 16''' is similar to the first three embodiments previously described in Drawings 1–18.

As shown in FIG. 19, in the run-in position the upper retractor 26''' in the area of shifting keys 38" extends only just short of pin 128, thus allowing link 126 to rotate counterclockwise, responsive to the force initiated from spring 130 against follower 132. In short, in the run-in position, the shifting keys 38''' are extended into groove 16''' and have pulled the shifting sleeve 12''' up to the position shown in FIG. 19. During this time, the overpull keys 32''' have remained retracted. Upon application of an upward pulling force to the top sub 20''', the upper retractor 26''' moves away from pin 138 and goes behind pin 140, thus liberating link 136 to rotate counterclockwise, which in turn allows the overpull keys 32''' to engage the groove 16'''.

Figure 20C:
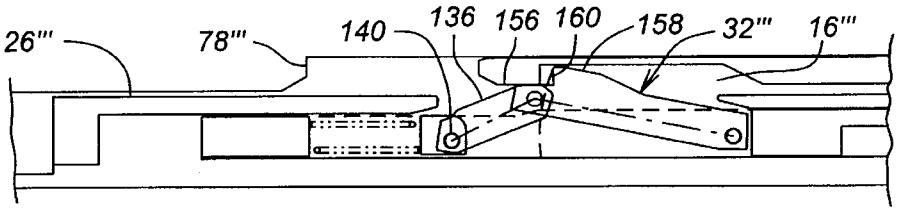
FIGS. 20*a* and 20*b* and 20*c* are the embodiment of FIG. 19, with the overpull key released.
Figure 20A:
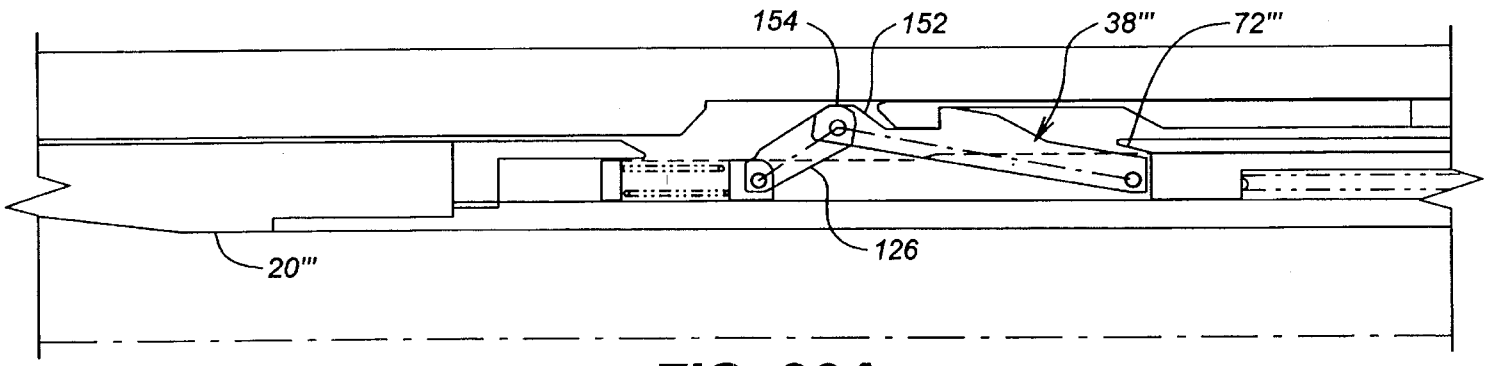
Figure 20B:
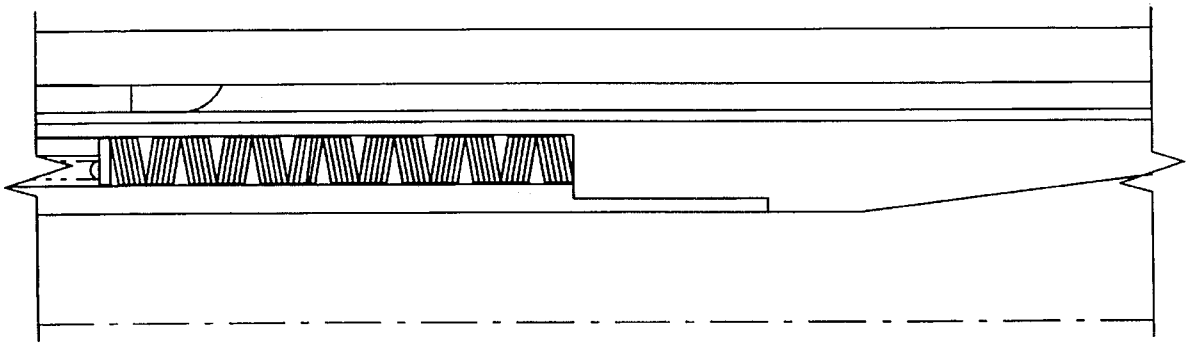

With regard to the overpull keys 32''', surfaces 158, 160, and 162 are formed to create a protrusion which extends into the groove 16'''. Surface 162 is oriented substantially parallel to surface 156 at the time of contact and, hence, is necessarily formed obliquely to the longitudinal centerline of link 126. Once sufficient shifting of the top sub 20''' has occurred, and upper retractor 26''' has liberated link 126 to rotate, the shifting keys 38''' and the overpull keys 32''' are now fully engaged in the groove 16'''. This position is illustrated in FIG. 20. Further application of force shifts the sliding sleeve 12'' closer to radial surface 78''', which results in link 126 engaging tapered surface 80'''. Any further movement upwardly of top sub 20''' will force the link 126 to rotate clockwise about pin 128, in effect forcing the shifting keys 38''' out of groove 16'''. This can be seen by comparing FIG. 22 to FIG. 21 where the shifting keys 38''' have been forced out of groove 16''', leaving only the overpull keys 32''' still engaged in groove 16'''. By this time, the sliding sleeve 12''' has been pulled up close to, if not against, radial surface 78'''.

At this time a predetermined overpull force is applied and seen on instrumentation at the surface. After the predetermined force is reached, the pulling force in top sub 20''' is removed and weight is set down on top sub 20'''. Setting down weight on the top sub 20''' brings down the upper retractor 26''' beyond pin 140 toward pin 138. This results in a forcing of the overpull keys 32''' into the position shown in FIG. 24 and out of the groove 16'''. The shifting keys 38''' may not reenter the groove 16''' because there is insufficient space above the top end 70''' to accommodate the pivot 124, including surfaces 154 and 152, which must enter the recess 14''' in order to allow proper engagement of the shifting keys 38''' into the groove 16'''. Therefore, the surface operating personnel will know, once they let down on top sub 20''' and pull back up if there is no relatching, that the sleeve 12''' has been fully shifted in recess 14'''.

Figure 22C:
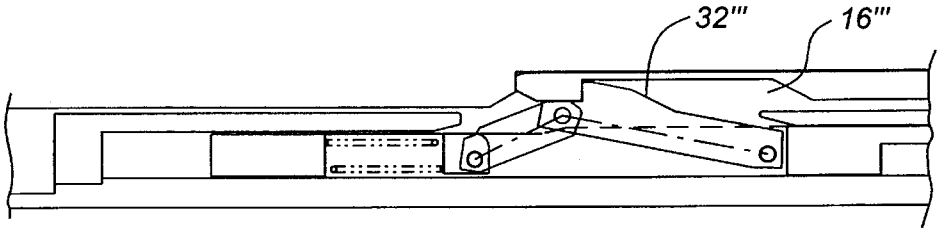
FIGS. 22*a* and 22*b* and 22*c* illustrate the shifting key disengaged from the sleeve and the overpull key fully engaged for overpulling.
Figure 22A:
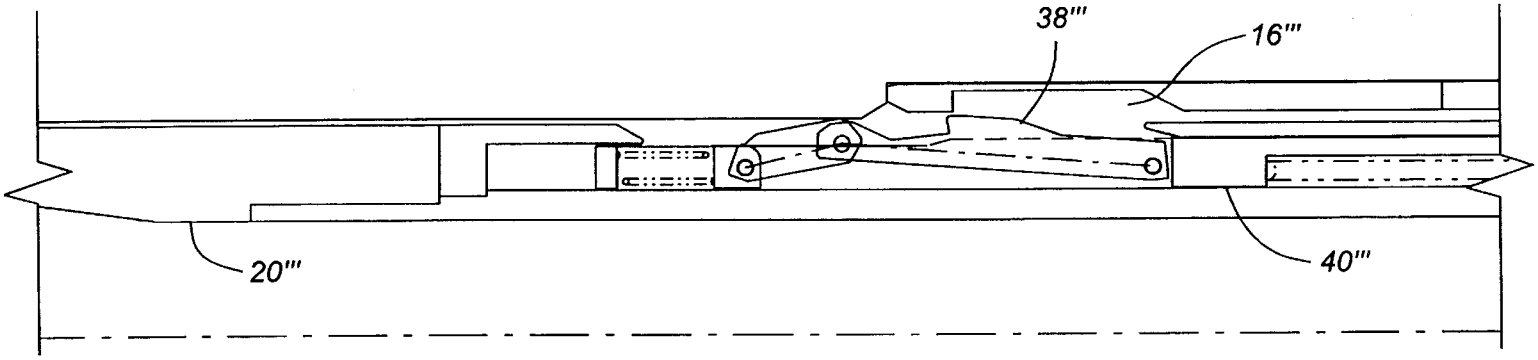
Figure 22B:
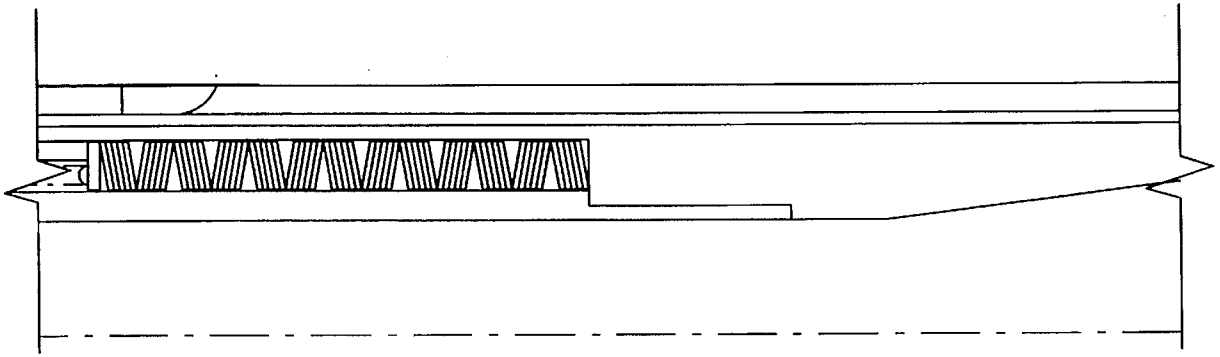
Figure 24C:
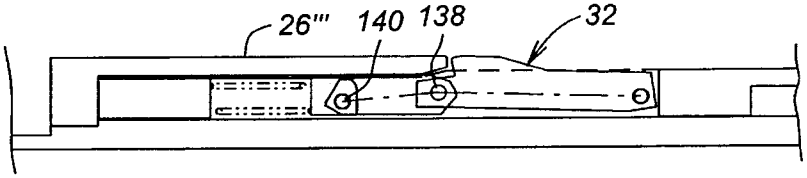
FIGS. 24*a* and 24*b* and 24*c* are the view of FIG. 22, showing the normal release where force is removed, retracting and retaining the overpull key while the shifting key cannot reenter the shifting sleeve due to the position of the sleeve.
Figure 24A:
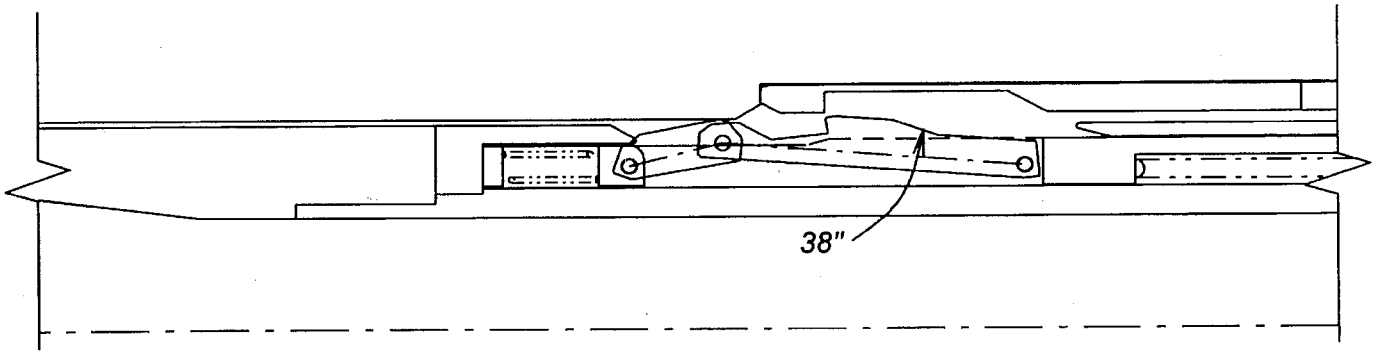
Figure 24B:
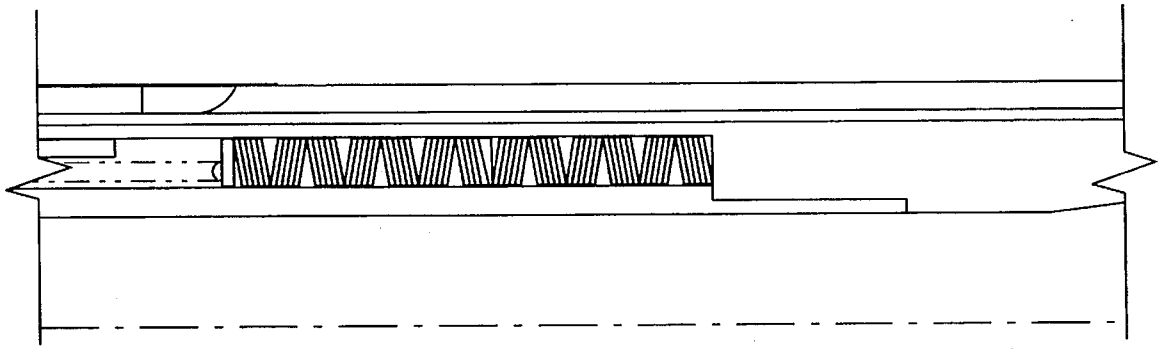

As before, FIG. 23 illustrates a mode of emergency release. With the overpull keys 32''' engaged as shown in FIG. 22, if a sufficient upward force is put on top sub 20''', key cage 40''' transmits a sufficient flattening force on washers 48''' to flatten them, bringing tapered surface 72''' into contact with link 134, forcing it to rotate counterclockwise to place the overpull keys 32''' in the position shown in FIG. 23. The upward movement of tapered surface 72''' also forces link 120 of shifting keys 32''' (and link 134, if it is still engaged to groove 16''') to rotate counterclockwise out of groove 16'''. After momentarily assuming the position shown in FIG. 23, the washers 48''' expand, thus shifting the overpull keys 32''' and the shifting key 38''' into the position illustrated in FIG. 24. The apparatus A resumes its run-in position where the emergency release feature is recocked in the run-in position to allow another grab of the sleeve 12 either in the same or opposite direction, or to move to another sleeve without pulling out of the hole. The apparatus A may now be removed from the wellbore.

The embodiment shown in FIGS. 25–30 operates substantially the same as the embodiment in FIGS. 19–24, with a few minor variations which will now be described. Bottom sub 24'''' is formed having a cavity 164 in which resides spring 166. Retrieving sleeve 44'''' is now slidably mounted with respect to bottom sub 24'''' and, in part, forms the cavity 164 which houses spring 166. A variable-volume cavity 168 is formed between seals 170 and 172 and has access to an internal passage 174 through lateral passage 176.

Figure 25C:
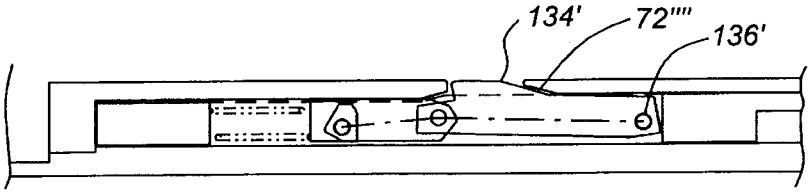
FIGS. 25*a* and 25*b* and 25*c* are an alternative embodiment of the invention shown in the run-in position with the shifting key and overpull key initially restrained.
Figure 25A:
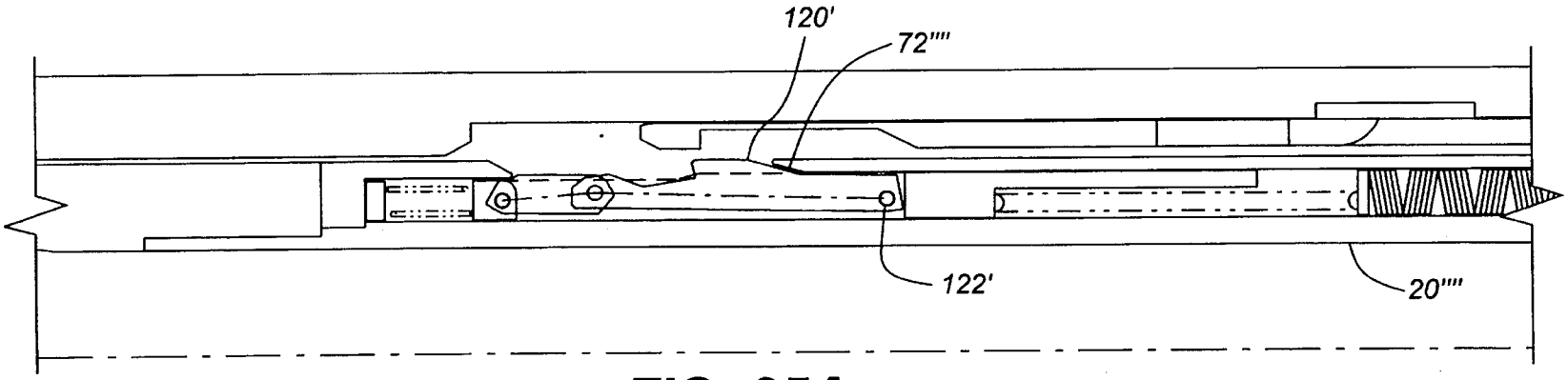
Figure 25B:
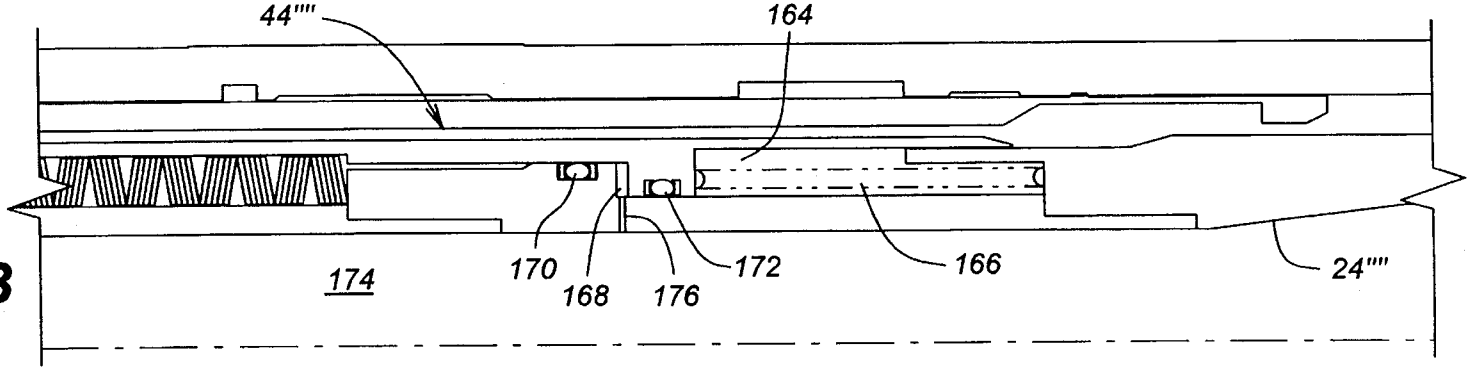
Figure 27C:
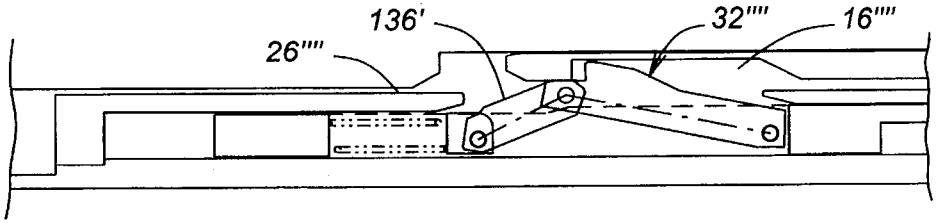
FIGS. 27*a* and 27*b* and 27*c* are the view of FIG. 26 after the overpull key is liberated for engagement with the shifting sleeve.
Figure 27A:
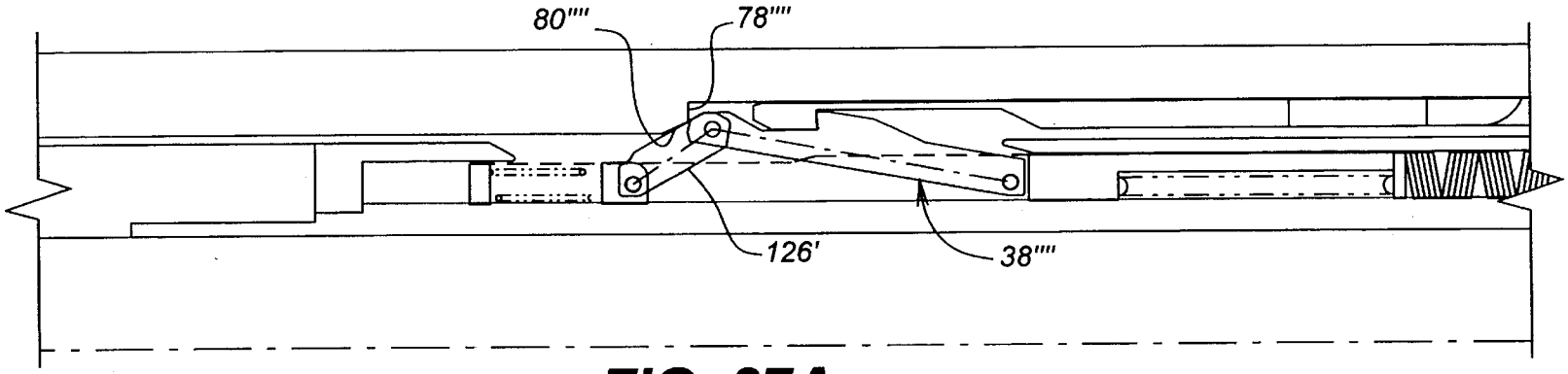
Figure 27B:
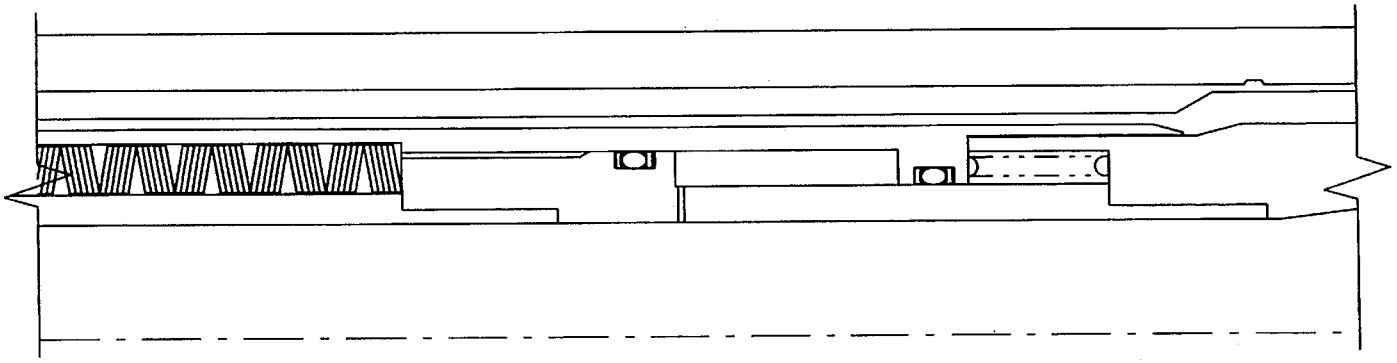

Those skilled in the art will appreciate that the pressure can be built up in variable-volume cavity 168 by, in one way or another, obstructing passage 174 or restricting it, creating a backpressure, which raises the pressure within variable-volume cavity 168. Spring 166 keeps the retrieving sleeve 44'''' in the position shown in FIG. 25 during run-in. In that position, tapered surface 72'''' extends over pins 122' and 136', thus holding links 120' and 134', respectively, aligned parallel to body 20'''', as shown in FIG. 25. With this feature, any of the above embodiments can be positioned adjacent any sleeve before the shifting keys 38 are allowed to extend.

Figure 21C:
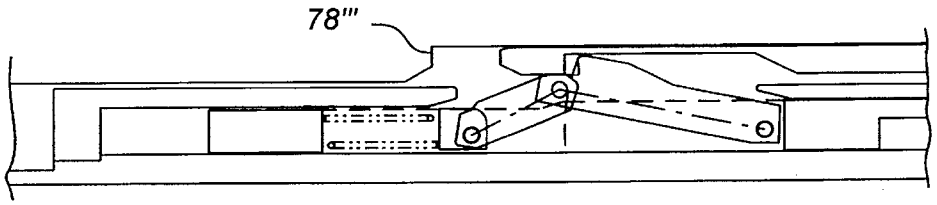
FIGS. 21*a* and 21*b* and 21*c* are the view of FIG. 20, with the overpull key engaged and the shifting key about to be cammed out of the shifting sleeve.
Figure 21A:
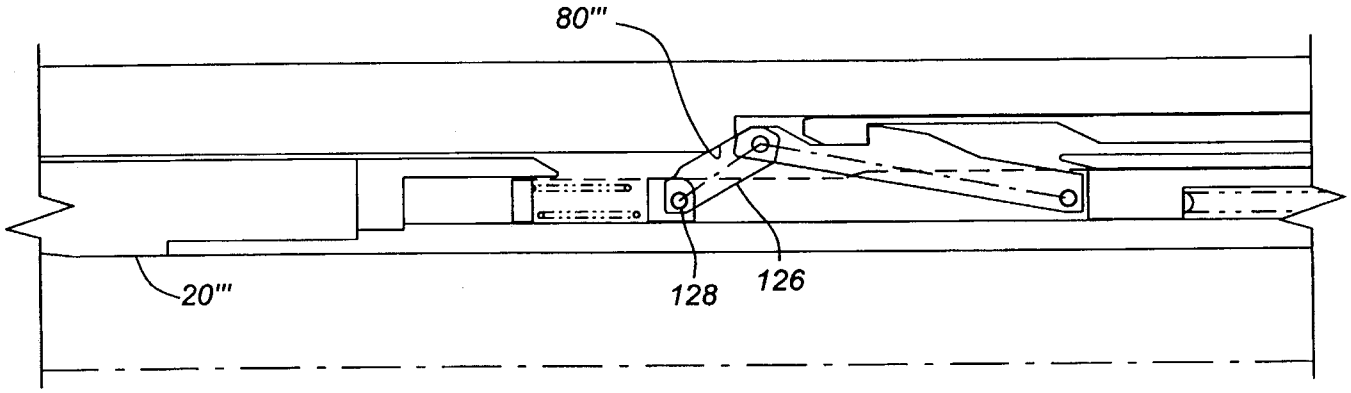
Figure 21B:
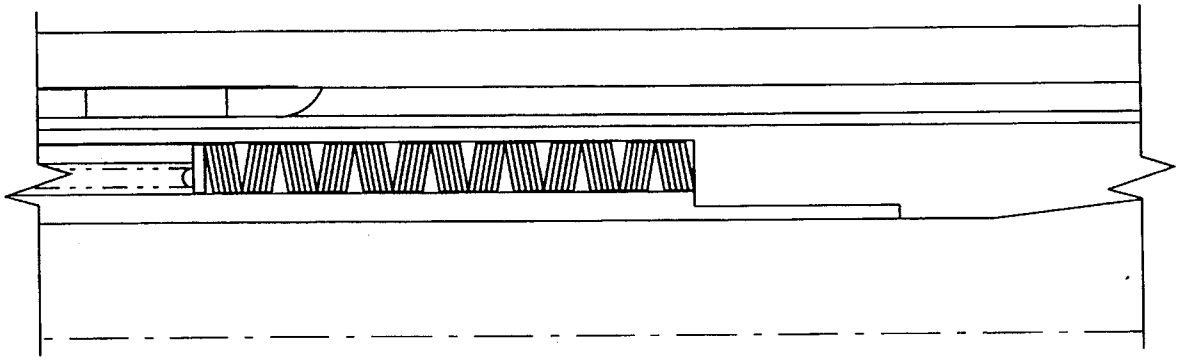

Upon application of pressure to variable-volume cavity 168, the force of spring 166 is overcome and the retrieving sub 44'''' is retracted, as shown in FIG. 26. At that time, as previously described for the embodiment of FIGS. 19–24, link 120' rotates clockwise into groove 16'''', thus securing the shifting keys 38'''' into the groove 16'''' so that the shifting sleeve 12'''' can be brought up to the position shown in FIG. 26. At that time, further movement of shifting sleeve 12'''' requires more effort, which results in an incremental force applied to the top sub 20''''. This, in turn, retracts the upper retractor 26'''' from its position where it effectively covers link 136', thus allowing link 136' to rotate clockwise to engage the overpull keys 32'''' into the groove 16'''', as shown in FIG. 21. At this time, both shifting keys 38'''' and overpull keys 32'''' are engaged in groove 16'''', As the shifting sleeve 12'''' moves closer towards radial surface 78'''', link 126' engages tapered surface 80'''', thus camming the shifting keys 38'''' out of groove 16''''. The conclusion of this motion can be seen by comparing FIGS. 27 and 28.

Figure 28C:
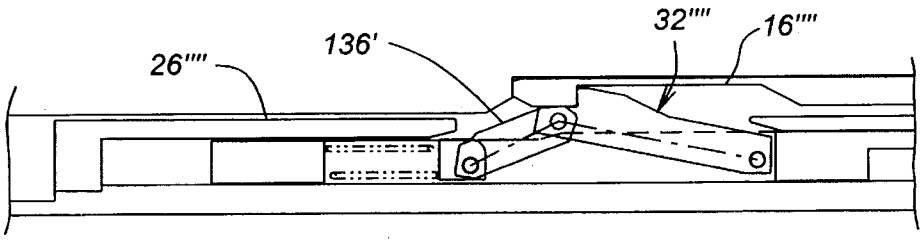
FIGS. 28*a* and 28*b* and 28*c* are the view of FIG. 27, showing the shifting key being cammed out of the shifting sleeve and an overpull pressure applied through the overpull key.
Figure 28A:
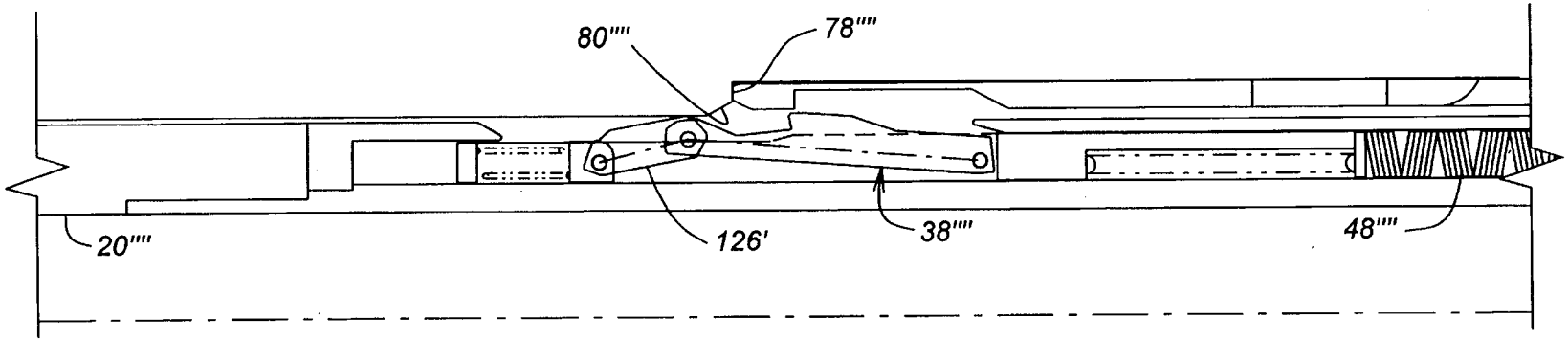
Figure 28B:
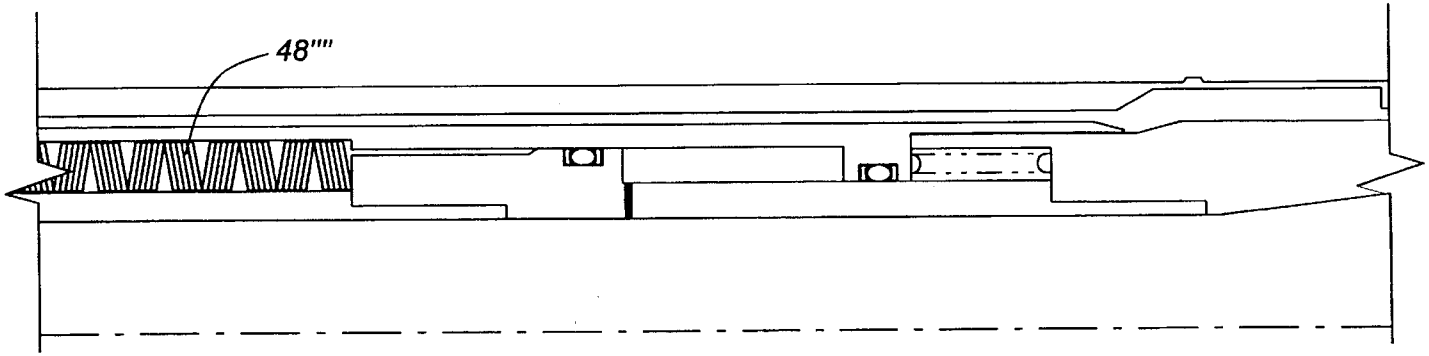
Figure 30C:
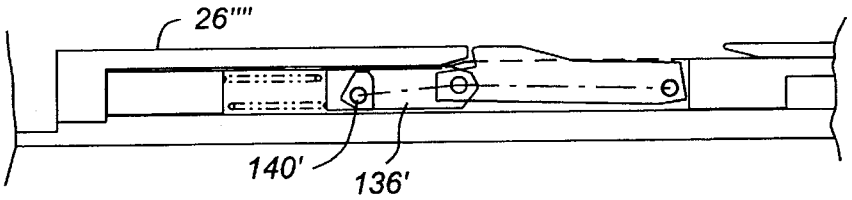
FIGS. 30*a* and 30*b* and 30*c* illustrate the normal release function of the tool shown in FIG. 28, where upon letup of a pulling force from the surface, the overpull key is cammed into a retracted position while the shifting key may not enter the sleeve due to its shifted position.
Figure 30A:
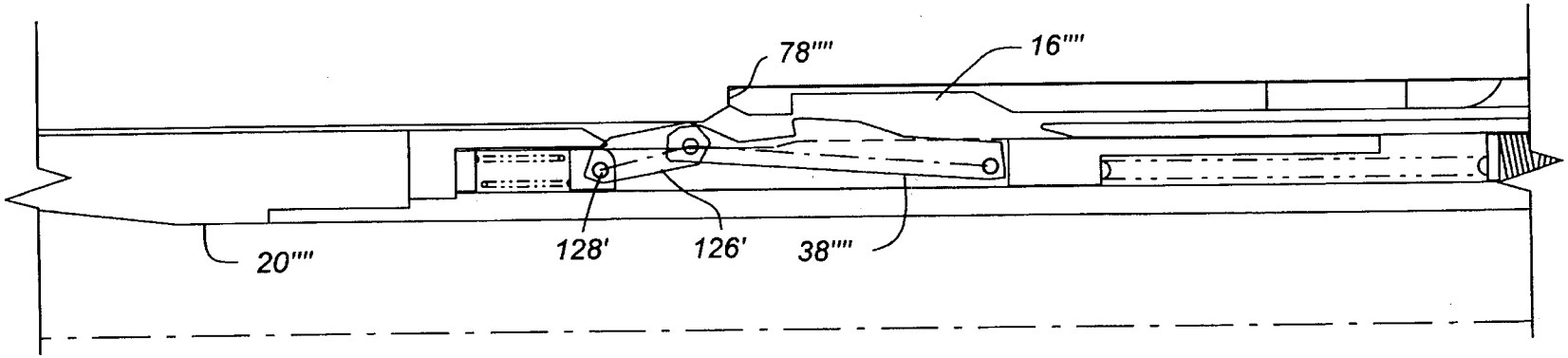
Figure 30B:
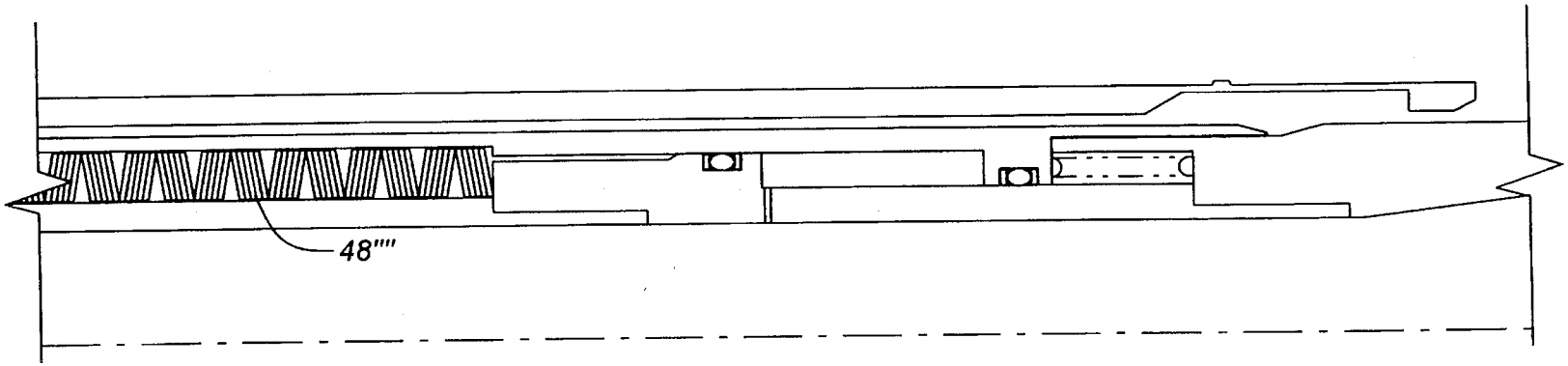

As shown in FIG. 28, the components are now in position for the application of the overpull force which results in the remaining movement of shifting sleeve 12'''' into contact with radial surface 78''''. Having achieved the predetermined overpull force, normal release is illustrated in FIG. 30, which involves setting down weight on top sub 20'''', which, in turn, allows upper retractor 26'''' to force clockwise rotation of link 136' about pin 140'. As previously described, the shifting keys 38'''' cannot re-engage the groove 16'''' because the shifting sleeve 12'''' has moved close enough or in contact with radial surface 78'''', precluding sufficient counterclockwise rotation of link 126' about pin 128'. The apparatus A can now be released from the shifting sleeve 12'''' by an upward pull when in the position shown during normal release in FIG. 30. This indicates to the surface that sleeve 12'''' is fully shifted.

An emergency release can be accomplished as well by simply increasing the overpull force from the position shown in FIG. 28. The result in the increase in applied force to top sub 20'''' is a flattening of Belleville washers 48'''', which, in turn, allows retrieving sleeve 44'''' to advance beyond pin 136', thus forcing link 134' to rotate counterclockwise, disengaging the overpull keys 32'''' (and the shifting keys 38'''', if still engaged) from groove 16''''. The shifting keys 38'''' are moved closer to body 22'''' as retrieving sleeve 44'''' passes over pin 122', forcing link 120' to rotate counterclockwise into the position shown in FIG. 29.

Figure 29C:
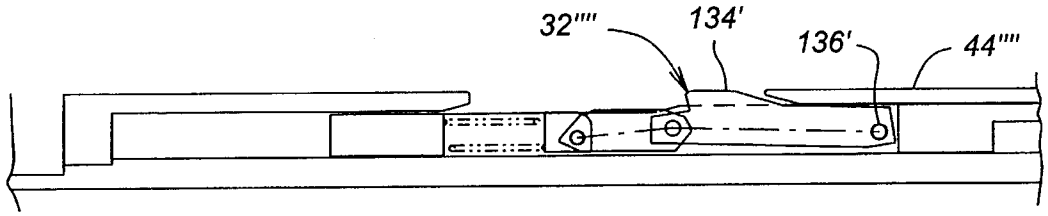
FIGS. 29*a* and 29*b* and 29*c* are an emergency release feature of the embodiment shown in FIG. 28 where, upon application of a predetermined force, the shifting and overpull keys are cammed out of the sleeve for removal of the tool.
Figure 29A:
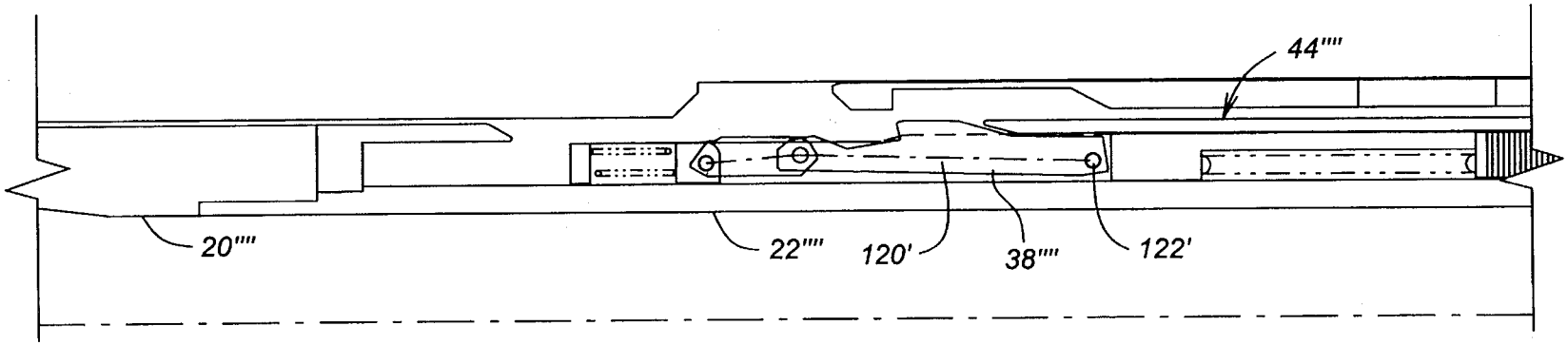
Figure 29B:
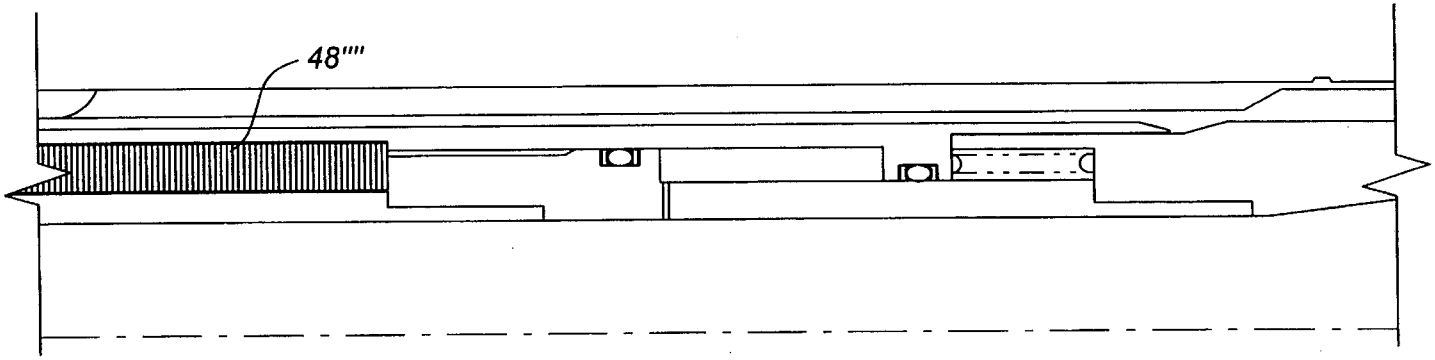

As soon as the position shown in FIG. 29 is achieved, the Belleville washers 48'''' expand, putting the apparatus A in the position shown in FIG. 30. The apparatus A resumes its run-in position where the emergency release feature is recocked in the run-in position to allow another of the sleeve 12 either in the same or opposite direction, or to move to another sleeve without pulling out of the hole. It can also be removed from the well. The applied pressure to variable-volume cavity 168 can be removed at any time, which will result in spring 166 reducing the size of variable-volume cavity 168 and advancing retrieving sleeve 44"" upwardly to, in effect, hold the shifting keys 38"" in the retracted position illustrated in FIG. 29.

Referring now to FIGS. 32 and 33, the preferred embodiment of the resettable emergency release feature is illustrated in the run-in and released position. If the shifting sleeve becomes stuck before advancing its entire stroke, the shifting key 200 will still be engaged in a groove (not shown) of the shifting sleeve. The overpull key 202 will also engage the groove when the retainer 204 is pulled out of the way. Springs 234 are used to apply an outward bias to the shifting and overpull keys 200 and 202. With the shifting key 200 engaged in the groove of the sleeve to be shifted, the cage 206 cannot move longitudinally in response to an upward pull through mandrel 208. With the cage 206 in a fixed position, ultimately shoulder 210 acts as an upward travel stop to the outer sleeve 212 when engagement occurs with shoulder 214, as shown in FIG. 33(*d*). This movement liberates the overpull key 202. In the preferred embodiment, an elongated split ring 216 is manufactured with an outward bias, then compressed and inserted into outer sleeve 212. It has a series of protrusions 218, each of which engages a mating depression 220 on a matching elongated split member 222. Member 222 rests on support ring 224, which has an internal shoulder 226. Part of the inner mandrel 208 has a mating shoulder 228 which will ultimately abut support ring 224 when an overpull force is applied through the inner mandrel 208. Since the outer sleeve 212 cannot move upwardly, it, in the preferred embodiment, acts as a unitary structure in combination with the elongated split member 216. As long as the protrusions 218 engage the depressions 220, the inner mandrel 208 cannot move upwardly. However, after a predetermined force is exceeded, the upward pressure on elongated split member 222, through ring 224, is so great as to overcome the force which keeps the protrusions 218 within the depressions 220. When this occurs, the movement illustrated in FIG. 33 ensues. The split member 222, which is longitudinally split, contracts radially to move the depressions 220 away from the protrusions 218. When this occurs, the inner mandrel 208 is free to move upwardly to ultimately cam the shifting and overpull keys 200 and 202 out of the groove by virtue of retracting sleeve 230, moving over the shifting and overpull keys 200 and 202 in the manner previously described. As seen in FIG. 33(*b*), the inner mandrel 208 has moved relatively to the outer sleeve 212. This results in a temporary compression of spring 232. Upon release of the shifting and overpull keys 200 and 202 from the sleeve, spring 232 will shift the outer sleeve 212 upwardly with respect to the inner mandrel 208 so that the position of run-in as shown in FIG. 32 is again resumed. When that occurs, the protrusions 218 are pulled upwardly until they, again, meet the depressions 220 to recock the apparatus A. At that point, the apparatus A can be reengaged to the sleeve or removed from the wellbore, as desired. If opposed assemblies are run as part of the apparatus, a pulling force can result in an emergency release, which can in turn then be followed by engagement of a sleeve in the opposite direction to try to move it in that direction. In either event, the apparatus A does not need to be removed from the wellbore and can be engaged to the sleeve numerous times and overpull forces applied in one or two directions to budge the sleeve. It can be emergency released numerous times without adversely affecting its ability to reengage.

It should be noted that while the preferred embodiment has the elongated split element 216 as a split element for ease of assembly, the longitudinal split in that element can be eliminated without departing from the spirit of the invention. Similarly, the element 216 can be fabricated as a unitary assembly or as an aggregation of assemblies, each having a protrusion 218. Of course, the relationship of the protrusions 218 and depressions 220 can be reversed on the elements without departing from the spirit of the invention. It should also be noted that during the normal overpull operations, the engagement between the protrusions 218 and depressions 220 is retained. The release point can be set at any desired value, depending on the profiles of the protrusions 218 and depressions 220. In all other respects, the apparatus illustrated in FIGS. 32 and 33 is similar in operation to what has previously been described for the other embodiments. Accordingly, the various embodiments which are preferred have been described with regard to the operation of the apparatus to reliably provide a way to engage a sleeve and apply a predetermined measurable force from the surface, with an opportunity to obtain feedback of the sleeve position as well as the amount of overpull force applied. These embodiments also disclose an emergency release provision in the apparatus which is resettable without removal of the tool from the wellbore.

While the use of a longitudinally split ring, which reduces in diameter in response to an applied load to facilitate disengagement and increases in diameter thereafter to facilitate reengagement, has been illustrated as the preferred embodiment, those skilled in the art will appreciate that alternative mechanisms, which facilitate engagement up to a predetermined force, then allow release followed by reengagement, are all within the framework of the resettable emergency release feature of this apparatus and may also be used as an emergency release resettable feature on a wide variety of downhole tools.

Based on the above description, those skilled in the art can appreciate that the apparatus of the present invention offers an advantage of giving feedback at the surface of the position of the shifting sleeve. Even if the sleeve only moves up part-way and an excessive force is applied, the only thing that will occur is an emergency release. However, the tool will not have to be brought to the surface to be redressed and will be immediately available for another grip, should that become necessary.

In summary, the beneficial features of the tool are as follows: As the tool is pulled up into the sliding sleeve, the shifting keys will automatically find the groove, if it is not within a predetermined distance from the stop. The sleeve will have an inherent resistance to motion, due to either the seal friction, a detent system, or combination of the two. As motion of the body continues, this will pull the retainer from on top of the pulling keys, allowing them to move out into the groove. Further application of force will normally cause the sleeve to move as the resistance is overcome. Motion will continue until the shifting keys engage the shoulder at the stop. Continued motion will cause the shifting keys to retract and release from the groove. The pulling keys will not release as they do not have the cam mechanism which contacts the release shoulder. Continued force will pull the sleeve up until it reaches the stop. At this point the force can be increased, beyond what would normally be expected as the load to shift the sleeve, to a point where it is significantly large enough to show up on the surface weight indicator. At a predetermined overpull load, the operator will stop. This is the first part of the surface indication.

The operator, after a normal overpull load is applied, will now relax the overpull load and move the shifting tool down the well until it is below the sleeve. As the shifting tool is pulled back up into the sleeve, one of two things can happen.

If the sleeve has been moved fully up, then the shifting keys cannot engage the sleeve. If they do not engage the sleeve, then the pulling keys will not be exposed and the shifting tool can come all the way through the sleeve. The operator will not see any significant increase in load as he pulls the shifting tool through the sleeve. If the sleeve has not moved all the way, then the shifting keys will reengage and a significant increase in the load on the weight indicator would be seen on the surface. This would indicate that the force applied was not sufficient to shift the sleeve.

The above sequence can now be repeated, increasing the overpull force beyond previous levels until it can be verified that the sleeve has shifted all the way. If no such indication can be found, i.e., the shifting tool will not release from the sleeve, then a force in excess of the emergency release mechanism can be applied to release the shifting tool. If a resettable emergency release mechanism is used, then further attempts can be made to fully shift the sleeve. If two opposing shifting tools have been run, then attempts may be made to free the stuck sleeve by attempting to move it in the opposite direction.

Prior designs, particularly those suited for run-in on wireline, had a shear release to protect the wireline from overstress. These designs did not provide the feedback available with the apparatus of the present invention, which is not only available but is also available without pulling out of the hole. Even when run in on rigid or coiled tubing in a straight or deviated wellbore, the apparatus A offers improvements over prior designs with the feedback feature and the ability to overpull a predetermined amount that can be detected at the surface. No longer will the operator have to guess what the meaning of a release downhole has been, such as when using shear release designs. No longer will the operator have to remove the tool from the wellbore, examine it and redress it in order to finally have some positive feedback of the actual position of the sleeve. Those skilled in the art will appreciate that the apparatus A can also be used as a fishing tool for any downhole equipment which has a configuration such as groove 16.

The tools would preferably be run in pairs, one oriented to shift up and one oriented to shift down. This would allow manipulation of multiple sleeves in either direction or, when using tools with the resettable emergency release mechanism, to apply force in either direction to free a sleeve which may have become jammed due to wellbore debris or damage.

Many sleeves can be operated with one trip. The shifting and pulling mechanisms can be retained with a sleeve or other member that is mechanically or hydraulically actuated until the proper sleeve for operation is reached, at which point the shifting and pulling mechanisms can be released for a grip with the groove.

The foregoing disclosure and description of the invention are illustrative and explanatory thereof, and various changes in the size, shape and materials, as well as in the details of the illustrated construction, may be made without departing from the spirit of the invention.

We claim:

1. A shifting tool for shifting at least one sleeve within a tubular in a wellbore to at least one stop on the tubular by engagement of at least one groove thereon, comprising:

a body;

a shifting mechanism selectively movable into the groove for shifting the sleeve toward the stop, said shifting mechanism formed in a manner that it can enter the groove only when the sleeve is positioned outside a predetermined distance of the stop;

a pulling mechanism on said body, selectively engageable with the groove to allow a predetermined force to be applied to the sleeve to urge it further beyond said shifting movement accomplished by said shifting mechanism.

2. The tool of claim 1, wherein:

said shifting mechanism can reengage the groove after a release from the groove responsive to a pulling force on said body without removal of said body from the tubular, unless the sleeve has moved within a predetermined distance of the stop, thus giving feedback as to the position of the sleeve.

3. The tool of claim 2, wherein:

said pulling mechanism acts on the sleeve, at least in part, independently of said shifting mechanism.

4. The tool of claim 3, further comprising:

a retainer on said body to keep said pulling mechanism retracted from entry into the groove until a predetermined force is applied to the sleeve through said shifting mechanism.

5. The tool of claim 4, wherein:

said shifting mechanism has a leading protrusion for camming said shifting mechanism out of the groove upon shifting of the sleeve sufficiently close to the stop to allow said protrusion to engage the tubular;

said pulling mechanism, when released by movement of said retainer, obtaining a grip on the sleeve prior to disengagement of the sleeve by said shifting mechanism.

6. The tool of claim 5, wherein:

said pulling mechanism is movably mounted to said body on a biased cage member;

said pulling mechanism, when engaged with the groove and in response to a force applied to said body, exerts an opposing force to said biasing of said cage member.

7. The tool of claim 6, wherein:

said shifting mechanism is movably mounted to said body on said cage member;

said biasing of said cage member comprises at least one first spring;

said shifting mechanism, when engaged to the groove and in response to a force applied to said body, applies a resisting force to said first spring.

8. The tool of claim 7, wherein:

said body comprises a retractor sleeve;

said body comprising a second spring acting on said cage member;

whereupon application of a predetermined force with said pulling mechanism, alone or with said shifting mechanism, engaged to the groove, said body moves with respect to said cage member as said second spring is compressed to bring said retractor sleeve in contact with said pulling mechanism to push it out of the groove for release from the sleeve.

9. The tool of claim 8, wherein:

the force required to overcome said second spring is significantly greater than the force required to overcome said first spring.

10. The tool of claim 7, wherein:

relative movement in a first direction of said body with respect to said shifting mechanism, when said shifting mechanism is engaged in the groove, moves said retainer away from said pulling mechanism to allow said pulling mechanism to engage the groove.

11. The tool of claim 10, wherein:

relative movement, in a second direction opposite said first direction, of said body with respect to said pulling mechanism, when said pulling mechanism is engaged in the groove, moves said retainer over said pulling mechanism to force it out of the groove.

12. The tool of claim 6, wherein:

relative movement between said body and said cage member, with at least one of said shifting and said pulling mechanisms engaged to the groove, continues in response to a force applied to said body until said body and said cage member become selectively engaged;

whereupon a predetermined overpulling force can be applied to overcome said selective engagement.

13. The tool of claim 12, wherein:

said selective engagement comprises at least one collet on said cage member.

14. The tool of claim 13, wherein:

said collet engages said body by virtue of engaging teeth or an engaging thread.

15. The tool of claim 11, wherein:

said shifting or pulling mechanisms comprise shaped lugs which are mounted to said cage member for substantially radially outward movement and have a profile facilitating engagement with the groove.

16. The tool of claim 11, wherein:

said shifting or pulling mechanisms comprise a pivoting linkage shaped, when rotated, to assume a profile which engages the groove.

17. The tool of claim 16, wherein:

said shifting mechanism comprises said pivoting linkage;

said body further comprises a movable sleeve to selectively retain said linkage to said body until actuated, whereupon said linkage is movable toward the groove.

18. The tool of claim 1, wherein:

said body further comprises a movable sleeve to selectively retain said shifting mechanism to said body until actuated, whereupon said shifting mechanism is movable toward the groove for engagement thereof.

19. The tool of claim 2, wherein:

said shifting or pulling mechanisms comprise shaped lugs which are mounted to said cage member for substantially radially outward movement and have a profile facilitating engagement with the groove.

20. The tool of claim 2, wherein:

said shifting or pulling mechanisms comprise a pivoting linkage shaped, when rotated, to assume a profile which engages the groove.

21. The tool of claim 20, wherein:

said shifting mechanism comprises said pivoting linkage;

said body further comprises a movable sleeve to selectively retain said linkage to said body until actuated, whereupon said linkage is movable toward the groove.

22. The tool of claim 8, wherein:

said second spring expands, after said pulling mechanism is pushed out of the groove by said retractor sleeve, and pushes said pulling mechanism back to a position where it is again retained by said retainer;

whereupon said shifting mechanism can reengage the groove without removal of said body from the wellbore, if the sleeve is more than a predetermined distance from the stop.

23. The tool of claim 8, wherein:

upon compression of said second spring, said retractor sleeve pushes out said shifting mechanism from the groove, whereupon said shifting mechanism is moved after said release where it may reengage the groove without removal of said body from the well, if the sleeve is more than a predetermined distance from the stop.

24. The tool of claim 1, wherein:

said pulling mechanism releases from the groove when a predetermined force is exceeded;

whereupon said shifting mechanism remains selectively engageable to the groove if the sleeve is not within a predetermined distance from the stop to provide feedback uphole through said body that the sleeve has or has not fully shifted.

25. The tool of claim 24, wherein:

said shifting mechanism, if still engaged to the groove when the predetermined force is exceeded, is also pushed out of the groove but can reenter the groove if subsequently aligned with the groove.

26. The tool of claim 24, wherein:

said body further comprises an emergency release mechanism to facilitate release of said pulling mechanism from the groove when said predetermined force is exceeded;

said emergency release mechanism resetting itself upon said release of said pulling mechanism from the groove, whereupon said groove can be gripped again by said shifting mechanism.

27. The tool of claim 26, wherein:

said release mechanism comprises an elongated split ring having at least one protrusion releaseably engageable with a depression on said body;

whereupon application of a force in excess of a predetermined force through said split ring, said split ring changes dimension, allowing release of the protrusion from the depression to facilitate relative movement between said body and said pulling mechanism for release from the groove.

28. The tool of claim 27, wherein:

said split ring is biased from said body to return said protrusion and depression to an engaging relation after said pulling mechanism releases from the groove.

29. The tool of claim 28, wherein:

said split ring has a plurality of protrusions, each retaining a corresponding depression on the body until said predetermined force is exceeded.

30. The tool of claim 3, further comprising:

a releasing mechanism on said body to facilitate disengagement from the groove by said pulling mechanism when said predetermined force is exceeded, thus defining an emergency release;

said pulling mechanism releasable from the groove, if said predetermined force is not exceeded, by removal of the applied force to said body and subsequent relative movement between said body and said pulling mechanism, thus defining a normal release after overpulling;

said shifting mechanism, without removal of said body from the wellbore, again being selectively movable into engagement with the groove, for an additional attempt to shift the sleeve if it had not been shifted to within the predetermined distance to the stop prior to either said emergency or normal release after overpulling.

31. The tool of claim 30, further comprising:

a plurality of shifting mechanisms with at least one to engage a groove for moving the sleeve in a first direction and another for engaging another groove for moving the sleeve in a second direction opposite said first direction, each said shifting mechanism selectively movable into the groove for shifting the sleeve toward the stop, each said shifting mechanism formed in a manner that it cannot enter the groove once the sleeve is positioned within a predetermined distance of a stop;

a plurality of pulling mechanisms with at least one to engage a groove for moving the sleeve in a first direction and another for engaging another groove for moving the sleeve in a second direction opposite said first direction, each said pulling mechanism selectively movable into the groove to allow a predetermined force to be applied to the sleeve to urge it further beyond said shifting movement accomplished by said shifting mechanism;

whereupon said sleeve can be pulled in a first direction followed by said normal release after overpulling or said emergency release and without removing said body from the wellbore, the sleeve can be regrabbed at any groove for a subsequent attempt to move it, either in said first or said second direction.

32. The tool of claim 1, further comprising:

a shifting mechanism retaining sleeve, selectively preventing said shifting mechanism from entering the groove until it is actuated, thereby allowing said body to pass one or more grooves on one or more sleeves until a preselected groove is reached.

33. The tool of claim 32, wherein:

said shifting mechanism retaining sleeve is pressure-actuated.

34. A shifting tool for engaging downhole at least one groove on a sleeve to move it toward a stop, comprising:

a body;

a shifting mechanism selectively movable into the groove for shifting the sleeve toward the stop, said shifting mechanism formed in a manner that it cannot enter the groove once the sleeve is positioned within a predetermined distance of the stop;

a release mechanism on said body operably connected to said shifting mechanism to facilitate a release of said shifting mechanism from the groove when a predetermined force applied to said body is exceeded;

said release mechanism resetting itself downhole after said shifting mechanism releases the groove, to facilitate reengagement of the groove by said shifting mechanism if said sleeve is beyond a predetermined distance from the stop.

35. A release mechanism for a downhole tool in a wellbore, comprising:

a body;

a gripping member on said body to engage the tool;

a release member movably mounted with respect to said body to secure said gripping member in renewable engagement with the tool until a predetermined force is applied to said body, whereupon said gripping member releases the tool and resets to allow said gripping member to get another grip.

36. The tool of claim 35, wherein said release member further comprises:

an elongated split ring mounted between said body and said gripping member, said ring changing in radial dimension when said predetermined force is reached to facilitate relative movement between said body and said gripping member for a release from the tool.

37. The tool of claim 36, further comprising:

at least one pair comprising of a projection and depression with one of said pair on said ring and one on said body;

whereupon application of a predetermined force, said pair, which had been in engagement to support the grip on the tool by said gripping member, becomes separated by a change in radial dimension of said ring, resulting in a separation of said pair by the ensuing relative movement between said body and said gripping member to release the tool.

38. The tool of claim 37, further comprising:

biasing means acting on said ring, after said separation of said pair to move said ring, to reunite said pair to allow said gripping member to become positioned for another engagement with the tool without removal of said body from the wellbore.

39. A method of obtaining position feedback regarding a shifting sleeve in a wellbore, comprising the steps of:

applying an initial shifting force to a sleeve through at least one key mounted on a tool;

applying an increased overpull force to the sleeve through said key;

observing on surface instrumentation the overpull force applied;

testing, without removal of the tool from the wellbore, to see if the tool can reengage the sleeve after overpulling;

determining whether or not the sleeve has fully shifted by the results of said testing step.

40. The method of claim 39, further comprising the steps of:

emergency releasing from a groove in the sleeve by exceeding said overpull force;

resetting said key with the tool in the wellbore after said emergency release;

attempting to reengage said key;

obtaining feedback as to sleeve position depending on whether or not reengagement has occurred.

41. The method of claim 40, further comprising the steps of:

providing at least one overpull key as one of said keys to engage the groove with the remaining key;

shaping said overpull key so that proximity to the stop will not push it out of the groove;

applying said overpull force through said overpull key.

42. The method of claim 41, further comprising the steps of:

retracting said overpull key from the groove with a first sleeve, if said predetermined force is not exceeded, and with a second sleeve if said predetermined force is exceeded;

allowing said overpull key to selectively be subsequently engaged to the groove without removing the tool from the wellbore.

43. The method of claim 40, further comprising the step of:

resetting an emergency release mechanism as part of said resetting said first key.

44. A method for resettably releasing from a downhole tool, comprising the steps of:

providing a gripping member on a body to selectively grip the downhole tool;

gripping the tool with said gripping member;

holding the position of the gripping member to said body with a release mechanism;

exceeding with an applied force the limits of the release mechanism to hold the gripping member in position;

moving the release mechanism;

releasing from the tool;

resetting the release mechanism downhole as a result of said release;

obtaining at least one other grip on the tool with the gripping member without coming out of the hole.

45. A method of obtaining feedback on whether a shifting tool has fully shifted a downhole tool, comprising the steps of:

applying a force to a sleeve significantly larger than the force normally required to shift the sleeve;

obtaining feedback on whether or not the sleeve has fully shifted depending on whether the shifting tool can reengage the sleeve after a release therefrom.

* * * * *